US010157564B2

(12) United States Patent
Park et al.

(10) Patent No.: US 10,157,564 B2
(45) Date of Patent: Dec. 18, 2018

(54) DISPLAY APPARATUS WITH SHARED SUB-PIXEL AND METHOD OF DRIVING THE SAME

(71) Applicant: Samsung Display Co., Ltd., Yongin-Si, Gyeonggi-Do (KR)

(72) Inventors: Sungjae Park, Wonju-si (KR); Jai-Hyun Koh, Hwaseong-si (KR); Yu-Kwan Kim, Incheon (KR); Jinpil Kim, Suwon-si (KR); Iksoo Lee, Seoul (KR); Namjae Lim, Gwacheon-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 15/644,448

(22) Filed: Jul. 7, 2017

(65) Prior Publication Data

US 2017/0309214 A1 Oct. 26, 2017

Related U.S. Application Data

(62) Division of application No. 14/796,579, filed on Jul. 10, 2015, now Pat. No. 9,728,116.

(30) Foreign Application Priority Data

Jul. 31, 2014 (KR) ..... 10-2014-0098227

(51) Int. Cl.
*G09G 3/20* (2006.01)

(52) U.S. Cl.
CPC ..... *G09G 3/2003* (2013.01); *G09G 3/2092* (2013.01); *G09G 2300/0443* (2013.01); *G09G 2300/0452* (2013.01); *G09G 2300/0465* (2013.01); *G09G 2310/08* (2013.01); *G09G 2320/0673* (2013.01); *G09G 2340/0457* (2013.01); *G09G 2340/06* (2013.01)

(58) Field of Classification Search
CPC ... G09G 2300/0443; G09G 2300/0452; G09G 2300/0465
See application file for complete search history.

(56) References Cited

U.S. PATENT DOCUMENTS

| | | | |
|---|---|---|---|
| 6,661,429 | B1 | 12/2003 | Phan |
| 7,417,648 | B2 | 8/2008 | Credelle |
| 7,583,279 | B2 | 9/2009 | Brown et al. |
| 7,705,810 | B2 | 4/2010 | Choi et al. |
| 8,094,172 | B2 | 1/2012 | Endo |
| 8,207,924 | B2 | 6/2012 | Horiuchi et al. |
| 8,780,133 | B2 | 7/2014 | Jeong et al. |
| 8,933,959 | B2 | 1/2015 | Brown et al. |

(Continued)

FOREIGN PATENT DOCUMENTS

| | | | |
|---|---|---|---|
| CN | 101336443 | A | 12/2008 |
| CN | 101663605 | A | 3/2010 |

(Continued)

*Primary Examiner* — Chun-Nan Lin
(74) *Attorney, Agent, or Firm* — Innovation Counsel LLP

(57) ABSTRACT

A display apparatus includes a display panel, a timing controller, a gate driver, and a data driver. The display panel includes a plurality of pixel groups. Each of the pixel groups includes a first pixel and a second pixel disposed adjacent to the first pixel. The first and second pixels together include n (n is an odd number equal to or greater than 3) sub-pixels. The first and second pixels share their collective {(n+1)/2}th sub-pixel.

6 Claims, 27 Drawing Sheets

(56) References Cited

U.S. PATENT DOCUMENTS

| | | | | |
|---|---|---|---|---|
| 9,182,626 | B2 | 11/2015 | Kim | |
| 9,257,081 | B2 | 2/2016 | Nakayama et al. | |
| 9,483,971 | B2 | 11/2016 | Guo et al. | |
| 2004/0051724 | A1 | 3/2004 | Elliott et al. | |
| 2004/0080479 | A1 | 4/2004 | Credelle | |
| 2004/0212633 | A1 | 10/2004 | Natori et al. | |
| 2004/0222999 | A1 | 11/2004 | Choi et al. | |
| 2004/0234163 | A1 | 11/2004 | Lee et al. | |
| 2005/0023439 | A1* | 2/2005 | Cartlidge ..... | G02B 27/0012 250/208.1 |
| 2006/0158466 | A1 | 7/2006 | Chien et al. | |
| 2006/0290831 | A1 | 12/2006 | You | |
| 2007/0257945 | A1 | 11/2007 | Miller et al. | |
| 2008/0252558 | A1 | 10/2008 | Kim et al. | |
| 2010/0277492 | A1 | 11/2010 | Frederick et al. | |
| 2011/0148908 | A1 | 6/2011 | Jeong et al. | |
| 2012/0206512 | A1* | 8/2012 | Kim ..... | G02F 1/133514 345/691 |
| 2012/0328229 | A1 | 12/2012 | Kogo et al. | |
| 2013/0148060 | A1* | 6/2013 | Kim ..... | G02F 1/133514 349/106 |
| 2014/0152714 | A1 | 6/2014 | Nakagawa et al. | |
| 2015/0235617 | A1 | 8/2015 | Guo et al. | |

FOREIGN PATENT DOCUMENTS

| | | | |
|---|---|---|---|
| CN | 102636894 | A | 8/2012 |
| CN | 103700329 | A | 4/2014 |
| CN | 103854570 | A | 6/2014 |
| JP | 2003248461 | A | 9/2003 |
| JP | 2007088656 | A | 4/2007 |
| JP | 2008292932 | A | 12/2008 |
| JP | 2009086278 | A | 4/2009 |
| JP | 2010096974 | A | 4/2010 |
| JP | 2011505017 | A | 2/2011 |
| JP | 2013008887 | A | 1/2013 |
| JP | 2013122588 | A | 6/2013 |
| JP | 2013125115 | A | 6/2013 |
| JP | 5321627 | B9 | 10/2013 |
| KR | 20040096273 | A | 11/2004 |
| KR | 10-0825106 | B1 | 4/2008 |
| KR | 10-2009-0010826 | A | 1/2009 |
| KR | 10-2009-0073903 | A | 7/2009 |
| KR | 10-2010-0003260 | A | 1/2010 |
| KR | 10-0995022 | B1 | 11/2010 |
| KR | 10-2011-026225 | A | 3/2011 |
| KR | 20110069282 | A | 6/2011 |
| KR | 10-1066416 | B1 | 9/2011 |
| KR | 10-2012-0093003 | A | 8/2012 |
| WO | 2008100826 | A1 | 8/2008 |
| WO | 2008144180 | A1 | 11/2008 |

* cited by examiner

FIG. 9A

RF1

| | | |
|---|---|---|
| 0 | 0.0625 | 0.0625 |
| 0.125 | 0.625 | 0 |
| 0 | 0.0625 | 0.0625 |

FIG. 9B

GF1

| | | |
|---|---|---|
| 0 | 0.125 | 0 |
| 0 | 0.625 | 0.125 |
| 0 | 0.125 | 0 |

FIG. 9C

BF1

| | | |
|---|---|---|
| 0.0625 | 0 | 0 |
| 0 | 0.25 | 0.125 |
| 0.0625 | 0 | 0 |

FIG. 11A

BF2

| | | |
|---|---|---|
| 0 | 0 | 0.0625 |
| 0.125 | 0.25 | 0 |
| 0 | 0 | 0.0625 |

FIG. 11B

WF2

| | | |
|---|---|---|
| 0 | 0.125 | 0 |
| 0.125 | 0.625 | 0 |
| 0 | 0.125 | 0 |

FIG. 11C

RF2

| | | |
|---|---|---|
| 0.0625 | 0.0625 | 0 |
| 0 | 0.625 | 0.125 |
| 0.0625 | 0.0625 | 0 |

FIG. 19A

RF11

| | | |
|---|---|---|
| 0.0625 | 0.125 | 0 |
| 0.125 | 0.375 | 0.125 |
| 0.0625 | 0.125 | 0 |

FIG. 19B

GF11

| | | |
|---|---|---|
| 0 | 15/256 | 15/256 |
| 15/256 | 47/256 | 6/256 |
| 0 | 15/256 | 15/256 |

FIG. 21A

GF22

| | | |
|---|---|---|
| 15/256 | 15/256 | 0 |
| 6/256 | 47/256 | 15/256 |
| 15/256 | 15/256 | 0 |

FIG. 21B

BF22

| | | |
|---|---|---|
| 0 | 0.125 | 0.0625 |
| 0.125 | 0.375 | 0.125 |
| 0 | 0.125 | 0.0625 |

DISPLAY APPARATUS WITH SHARED SUB-PIXEL AND METHOD OF DRIVING THE SAME

CROSS-REFERENCE TO RELATED APPLICATION

This application is a divisional application of U.S. patent application Ser. No. 14/796,579 filed on Jul. 10, 2015, which claims priority to Korean Patent Application No. 10-2014-0098227, filed on Jul. 31, 2014, the contents of which are hereby incorporated by reference in their entirety.

BACKGROUND

1. Field of Disclosure

The present disclosure relates generally to flat panel displays. More specifically, the present disclosure relates to a flat panel display apparatus and a method of driving the flat panel display apparatus.

2. Description of the Related Art

In general, a typical display apparatus includes pixels, each being configured to include three sub-pixels respectively displaying red, green, and blue colors. This structure is called an RGB stripe structure.

In recent years, brightness of the display apparatus has been improved by using an RGBW structure in which one pixel is configured to include four sub-pixels, e.g., red, green, blue, and white sub-pixels. In addition, a structure has been suggested in which two sub-pixels among the red, green, blue, and white sub-pixels are formed in each pixel. This structure has been suggested to improve an aperture ratio and a transmittance of the display apparatus.

SUMMARY

The present disclosure provides a display apparatus having improved aperture ratio and transmittance.

The present disclosure provides a display apparatus having improved color reproducibility.

The present disclosure provides a method of driving the display apparatus.

Embodiments of the inventive concept provide a display apparatus that includes a display panel, a timing controller, a gate driver, and a data driver.

The display panel includes a plurality of pixel groups each comprising a first pixel and a second pixel disposed adjacent to the first pixel. The first and second pixels together include n (where n is an odd number equal to or greater than 3) sub-pixels.

The timing controller performs a rendering operation on an input data so as to generate an output data corresponding to the sub-pixels.

The gate driver applies gate signals to the sub-pixels.

The data driver applies data voltages corresponding to the output data to the n sub-pixels. The first and second pixels share an {(n+1)/2}th one of the sub-pixels and each of the n sub-pixels is included in one of the pixel groups.

The display panel can include a repeated arrangement of the sub-pixel group, where the sub-pixel group is configured to include eight sub-pixels arranged in two rows by four columns or in four rows by two columns, and the sub-pixel group includes two red sub-pixels, two green sub-pixels, two blue sub-pixels, and two white sub-pixels.

The display panel can include a repeated arrangement of the sub-pixel group, where the sub-pixel group is configured to include ten sub-pixels arranged in two rows by five columns or in five rows by two columns, and the sub-pixel group includes two red sub-pixels, two green sub-pixels, two blue sub-pixels, and four white sub-pixels.

The display panel can include a repeated arrangement of the sub-pixel group, where the sub-pixel group is configured to include ten sub-pixels arranged in two rows by five columns or in five rows by two columns, and the sub-pixel group includes three red sub-pixels, three green sub-pixels, two blue sub-pixels, and two white sub-pixels.

The display panel can include a repeated arrangement of the sub-pixel group, where the sub-pixel group is configured to include ten sub-pixels arranged in two rows by five columns or in five rows by two columns, and the sub-pixel group includes two red sub-pixels, four green sub-pixels, two blue sub-pixels, and two white sub-pixels.

The display panel can include a repeated arrangement of the sub-pixel group, where the sub-pixel group is configured to include twelve sub-pixels arranged in two rows by six columns or in six rows by two columns, and the sub-pixel group includes four red sub-pixels, four green sub-pixels, two blue sub-pixels, and two white sub-pixels.

The display panel can include a repeated arrangement of the sub-pixel group, where the sub-pixel group is configured to include three sub-pixels arranged in one row by three columns or in three rows by one column, and the sub-pixel group includes one red sub-pixel, one green sub-pixels, and one blue sub-pixel.

The {(n+1)/2}th sub-pixel may be a white sub-pixel.

Each of the first and second pixels may have an aspect ratio of about 1:1.

The variable n may equal 5.

The sub-pixels included in each of the first and second pixels may display three different colors.

The display panel may further include gate lines and data lines. The gate lines may extend in a first direction and be connected to the sub-pixels. The data lines may extend in a second direction crossing the first direction and be connected to the sub-pixels. The first and second pixels may be disposed adjacent to each other along the first direction.

Each of the sub-pixels may have an aspect ratio of about 1:2.5.

The sub-pixels may include first, second, third, fourth, and fifth sub-pixels sequentially arranged along the first direction. Each of the first and fourth sub-pixels may have an aspect ratio of about 2:3.75, each of the second and fifth sub-pixels may have an aspect ratio of about 1:3.75, and the third sub-pixel may have an aspect ratio of about 1.5:3.75.

The first and second pixels may be disposed adjacent to each other along the second direction.

Each of the sub-pixels may have an aspect ratio of about 2.5:1.

The variable n may equal 3.

The sub-pixels included in each of the first and second pixels may display two different colors.

The sub-pixel groups may each include a first pixel group and a second pixel group disposed adjacent to the first pixel group along the second direction. The first pixel group includes a plurality of sub-pixels arranged in a first row and the second pixel group includes a plurality of sub-pixels arranged in a second row. The sub-pixels arranged in the second row are offset from the sub-pixels arranged in the first row by a half of a width of a sub-pixel in the first direction.

Each of the sub-pixels may have an aspect ratio of about 1:1.5.

The first and second pixels may be disposed adjacent to each other along the second direction.

Each of the sub-pixels may have an aspect ratio of about 1.5:1.

The timing controller may include a gamma compensating part, a gamut mapping part, a sub-pixel rendering part, and a reverse gamma compensating part. The gamma compensating part linearizes the input data. The gamut mapping part maps the linearized input data to an RGBW data configured to include red, green, blue, and white data. The sub-pixel rendering part renders the RGBW data to generate rendering data respectively corresponding to the sub-pixels. The reverse gamma compensating part nonlinearizes the rendering data.

The sub-pixel rendering part may include a first rendering part and a second rendering part. The first rendering part may generate an intermediate rendering data configured to include a first pixel data corresponding to the first pixel, and a second pixel data corresponding to the second pixel. The intermediate rendering data may be generated from the RGBW data using a re-sample filter. The second rendering part may calculate a first shared sub-pixel data from a portion of the first pixel data corresponding to the {(n+1)/2}th sub-pixel, and a second shared sub-pixel data from a portion of the second pixel data corresponding to the {(n+1)/2}th sub-pixel, so as to generate a shared sub-pixel data.

Rendering may be performed using a separate re-sample filter for each normal and/or shared sub-pixel. These filters may have any number and value of scale coefficients.

The first and second pixel data may include normal sub-pixel data corresponding to other sub-pixels besides the {(n+1)/2}th sub-pixel, and the second rendering part may not render the normal sub-pixel data.

The first pixel data may be generated from RGBW data for first through ninth pixel areas surrounding the first pixel, and the second pixel data may be generated from RGBW data for fourth through twelfth pixel areas surrounding the second pixel.

Embodiments of the inventive concept provide a display apparatus including a plurality of pixels and a plurality of sub-pixels. The pixels include a shared sub-pixel shared by two pixels adjacent to each other, and a normal sub-pixel included in each of the pixels. The number of the sub-pixels is x.5 times greater than the number of the pixels, where the x is a natural number.

The variable x may be 1 or 2. Each of the shared sub-pixel and the normal sub-pixel may have an aspect ratio of about 1:2.5 or about 1:1.5.

Embodiments of the inventive concept provide a method of driving a display apparatus, including mapping an input data to an RGBW data configured to include red, green, blue, and white data; generating a first pixel data corresponding to a first pixel and a second pixel data corresponding to a second pixel disposed adjacent to the first pixel, of the first and second pixel data generated from the RGBW data; and calculating a first shared sub-pixel data from a portion of the first pixel data corresponding to a shared sub-pixel shared by the first and second pixels, and a second shared sub-pixel data from a portion of the second pixel data corresponding to the shared sub-pixel, so as to generate a shared sub-pixel data.

The shared sub-pixel data may be generated by adding the first shared sub-pixel data and the second shared sub-pixel data. The shared sub-pixel data may have a maximum grayscale corresponding to a half of a maximum grayscale of normal sub-pixel data respectively corresponding to normal sub-pixels that are not shared sub-pixels.

Embodiments of the inventive concept provide a display apparatus including a display panel, a timing controller, a gate driver, and a data driver. The display panel includes a plurality of pixel groups each including a first pixel and a second pixel disposed adjacent to the first pixel. The first and second pixels together include n (n is an odd number equal to or greater than 3) sub-pixels.

The timing controller generates, from input data, a first pixel data corresponding to the first pixel and a second pixel data corresponding to the second pixel, and generates a shared sub-pixel data corresponding to an {(n+1)/2}th sub-pixel on the basis of the first and second pixel data.

The gate driver may apply gate signals to the sub-pixels; and

The data driver may apply, to the sub-pixels, a data voltage corresponding to a portion of the first pixel data, a portion of the second pixel data, and the shared sub-pixel data.

According to the above, the transmittance and the aperture ratio of the display apparatus may be improved. In addition, the color reproducibility of the display apparatus may be improved.

BRIEF DESCRIPTION OF THE DRAWINGS

The above and other advantages of the present disclosure will become readily apparent by reference to the following detailed description when considered in conjunction with the accompanying drawings, wherein:

FIGS. 9A, 9B, and 9C are views showing a re-sample filter used to generate a first pixel data shown in FIG. 8;

FIGS. 11A, 11B, and 11C are views showing a re-sample filter used to generate a second pixel data shown in FIG. 10;

FIGS. 19A and 19B are views showing a re-sample filter used to generate a first pixel data shown in FIG. 18;

FIGS. 21A and 21B are views showing a re-sample filter used to generate a second pixel data shown in FIG. 20;

Figure 1:
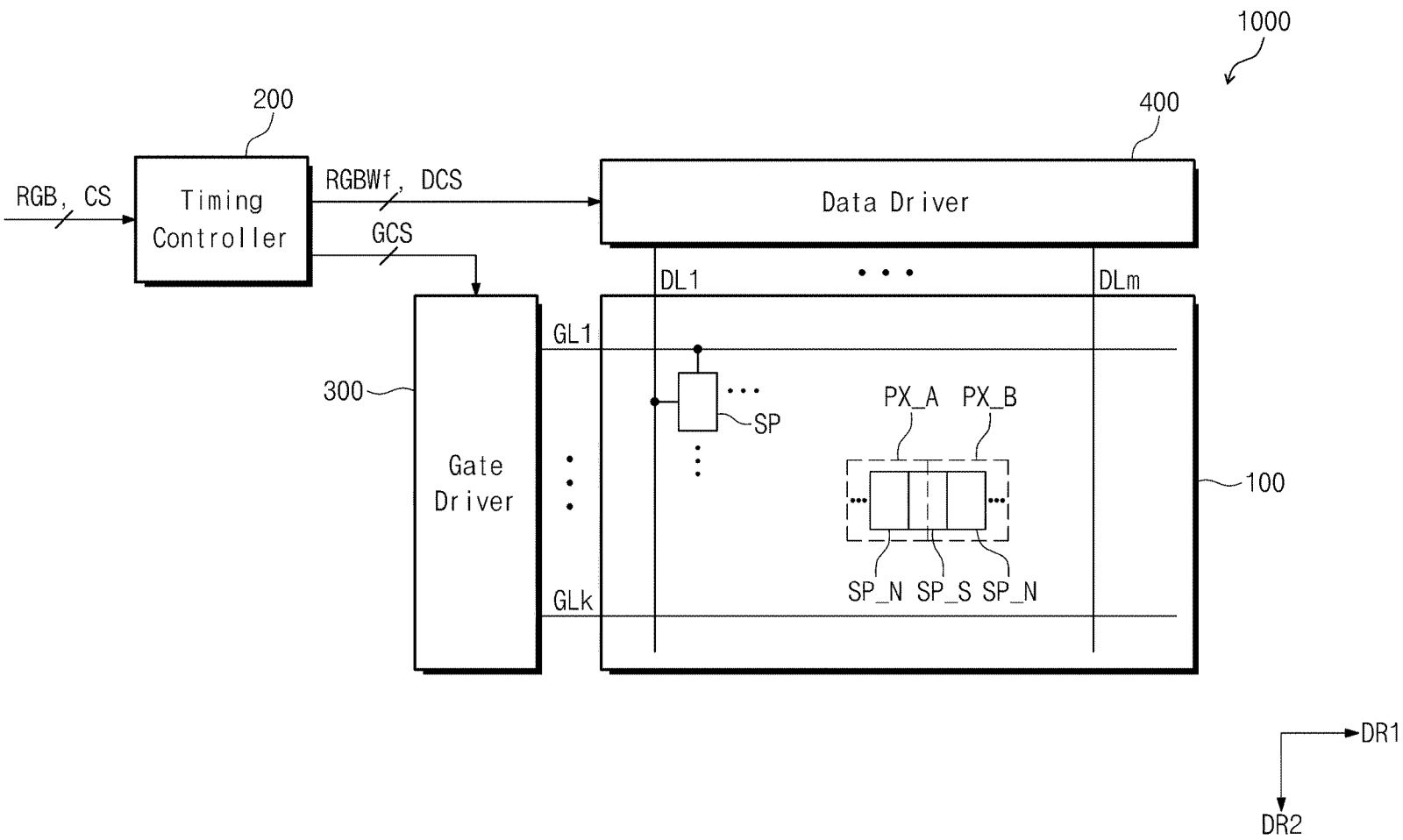
FIG. 1 is a block diagram showing a display apparatus according to an exemplary embodiment of the present disclosure.

The various Figures are not necessarily to scale.

DETAILED DESCRIPTION

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All numerical values are approximate, and may vary.

Hereinafter, the present invention will be explained in detail with reference to the accompanying drawings.

FIG. 1 is a block diagram showing a display apparatus 1000 according to an exemplary embodiment of the present disclosure.

Referring to FIG. 1, the display apparatus 1000 includes a display panel 100, a timing controller 200, a gate driver 300, and a data driver 400.

The display panel 100 displays an image. The display panel 100 may be any one of a variety of display panels, such as a liquid crystal display panel, an organic light emitting display panel, an electrophoretic display panel, an electrowetting display panel, etc.

When the display panel 110 is a self-luminous display panel, e.g., an organic light emitting display panel, the display apparatus 1000 does not require a backlight unit (not shown) that supplies a light to the display panel 110. However, when the display panel 110 is a non-self luminous display panel, e.g., a liquid crystal display panel, the display apparatus 1000 may further include a backlight unit (not shown) to supply light to the display panel 100.

The display panel 100 includes a plurality of gate lines GL1 to GLk extending in a first direction DR1, and a plurality of data lines DL1 to DLm extending in a second direction DR2 crossing the first direction DR1.

The display panel 100 includes a plurality of sub-pixels SP. Each of the sub-pixels SP is connected to a corresponding gate line of the gate lines GL1 to GLk and a corresponding data line of the data lines DL1 to DLm. FIG. 1 shows the sub-pixel SP connected to the first gate line GL1 and the first data line DL1 as a representative example.

The display panel 100 includes a plurality of pixels PX_A and PX_B. Each of the pixels PX_A and PX_B includes (x.5) sub-pixels ("x" is a natural number). That is, each of the pixels PX_A and PX_B includes x normal sub-pixels SP_N and a predetermined portion of one shared sub-pixel SP_S. The two sub-pixels PX_A and PX_B share one shared sub-pixel SP_S. This will be described in further detail below.

The timing controller 200 receives input data RGB and a control signal CS from an external graphic controller (not shown). The input data RGB includes red, green, and blue image data. The control signal CS includes a vertical synchronization signal as a frame distinction signal, a horizontal synchronization signal as a row distinction signal, and a data enable signal maintained at a high level during a period in which data are output, to indicate a data input period.

The timing controller 200 generates data corresponding to the sub-pixels SP on the basis of the input data RGB, and converts a data format of the generated data to a data format appropriate to an interface between the timing controller 200 and the data driver 400. The timing controller 200 applies the converted output data RGBWf to the data driver 400. In detail, the timing controller 200 performs a rendering operation on the input data RGB to generate the data corresponding to the format of sub-pixels SP.

The timing controller 200 generates a gate control signal GCS and a data control signal DCS on the basis of the control signal CS. The timing controller 200 applies the gate control signal GCS to the gate driver 300 and applies the data control signal DCS to the data driver 400.

The gate control signal GCS is used to drive the gate driver 300 and the data control signal DCS is used to drive the data driver 400.

The gate driver 300 generates gate signals in response to the gate control signal GCS and applies the gate signals to the gate lines GL1 to GLk. The gate control signal GCS includes a scan start signal indicating a start of scanning, at least one clock signal controlling an output period of a gate on voltage, and an output enable signal controlling the maintaining of the gate on voltage.

The data driver 400 generates grayscale voltages in accordance with the converted output data RGBWf in response to the data control signal DCS, and applies the grayscale voltages to the data lines DL1 to DLm as data voltages. The data control signal DCS includes a horizontal start signal indicating a start of transmitting of the converted output data RGBWf to the data driver 400, a load signal indicating application of the data voltages to the data lines DL1 to DLm, and an inversion signal (which corresponds to the liquid crystal display panel) inverting a polarity of the data voltages with respect to a common voltage.

Each of the timing controller 200, the gate driver 300, and the data driver 400 is directly mounted on the display panel 100 in one integrated circuit chip package or more, attached to the display panel 100 in a tape carrier package form after being mounted on a flexible printed circuit board, or mounted on a separate printed circuit board. On the other hand, at least one of the gate driver 300 and the data driver 400 may be directly integrated into the display panel 100 together with the gate lines GL1 to GLk and the data lines DL1 to DLm. Further, the timing controller 200, the gate driver 300, and the data driver 400 may be integrated with each other into a single chip.

In the present exemplary embodiment, one pixel includes two and a half sub-pixels or one and a half sub-pixels. Hereinafter, the case that one pixel includes two and a half sub-pixels will be described in more detail, and then the case that one pixel includes one and a half sub-pixels will be described in further detail.

Figure 2:
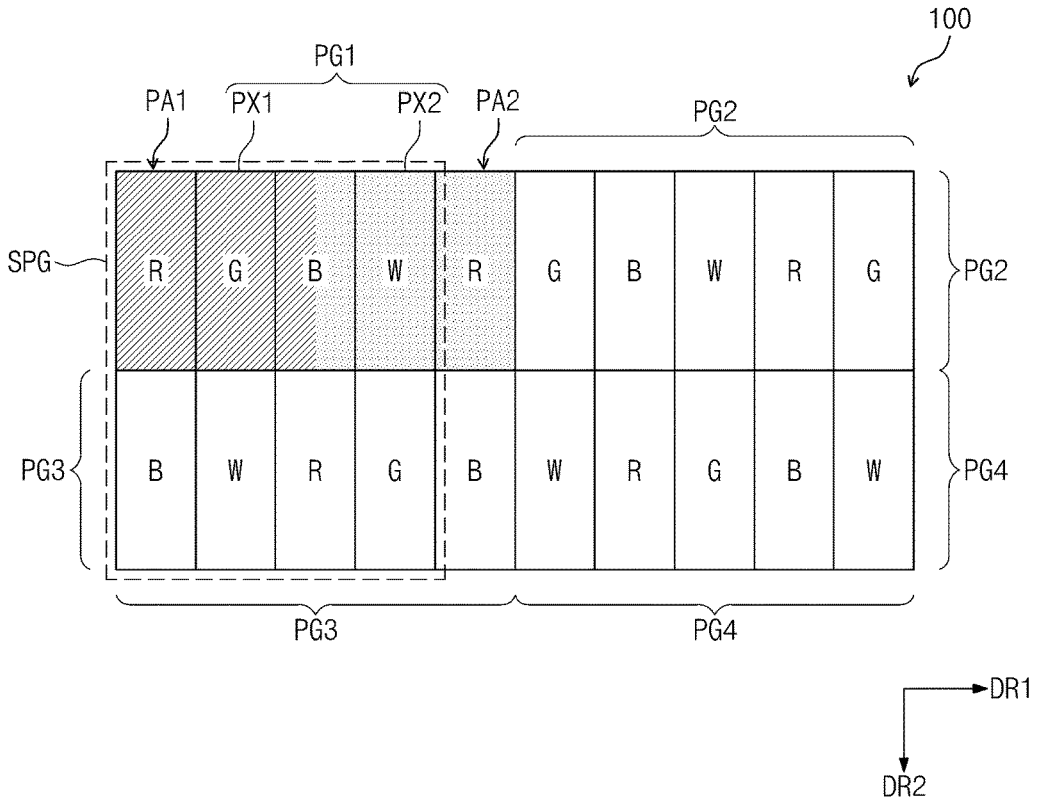
FIG. 2 is a view showing a portion of a display panel shown in FIG. 1 according to an exemplary embodiment of the present disclosure.

FIG. 2 is a view showing a portion of the display panel 100 shown in FIG. 1 according to an exemplary embodiment of the present disclosure.

Referring to FIG. 2, the display panel 100 includes the sub-pixels R, G, B, and W. The sub-pixels R, G, B, and W display primary colors. In the present exemplary embodiment, the primary colors are configured to include red, green, blue, and white colors. Accordingly, the sub-pixels R, G, B, and W are configured to include a red sub-pixel R, a green sub-pixel G, a blue sub-pixel B, and a white sub-pixel W. Meanwhile, the primary colors should not be limited to the above-mentioned colors. That is, the primary colors may further include yellow, cyan, and magenta colors, or any other sets of colors that can be considered as color primaries.

The sub-pixels are repeatedly arranged in sub-pixel groups (SPGs) each configured to include eight sub-pixels arranged in two rows by four columns. Each sub-pixel group SPG includes two red sub-pixels R, two green sub-pixels G, two blue sub-pixels B, and two white sub-pixels W.

In the sub-pixel group SPG shown in FIG. 2, the sub-pixels in a first row are arranged along the first direction DR1 in order of the red, green, blue, and white sub-pixels R, G, B, and W. In addition, the sub-pixels in a second row are arranged along the first direction DR1 in order of the blue, white, red, and green sub-pixels B, W, R, and G. However, the arrangement order of the sub-pixels of the sub-pixel group SPG should not be limited thereto or thereby. Any order of sub-pixels of any color is contemplated.

The display panel 100 includes pixel groups PG1 to PG4. Each of the pixel groups PG1 to PG4 includes two pixels adjacent to each other. FIG. 2 shows four pixel groups PG1 to PG4 as a representative example. The pixel groups PG1 to PG4 each have the same structure except for the arrangement order of the sub-pixels included therein. Hereinafter, a first pixel group PG1 will be described in further detail.

The first pixel group PG1 includes a first pixel PX1 and a second pixel PX2 adjacent to the first pixel PX1 along the first direction DR1. In FIG. 2, the first pixel PX1 and the second pixel PX2 are displayed with different hatch patterns.

The display panel 100 includes a plurality of pixel areas PA1 and PA2, in which the pixels PX1 and PX2 are disposed, respectively. In this case, the pixels PX1 and PX2 exert influence on a resolution of the display panel 100 and the pixel areas PA1 and PA2 refer to areas in which the pixels are disposed. Each of the pixel areas PA1 and PA2 displays three different colors.

Each of the pixel areas PA1 and PA2 corresponds to an area in which a ratio, e.g., an aspect ratio, of a length along the first direction DR1 to a length along the second direction DR2 is 1:1. That is, each pixel area PA1, PA2 is a square-shaped area. Hereinafter, one pixel may include a portion of one sub-pixel due to the shape (aspect ratio) of the pixel area. According to the present exemplary embodiment, one independent sub-pixel, e.g., the blue sub-pixel B of the first pixel group PG1, is not fully included in one pixel. That is, part of one independent sub-pixel, e.g., the blue sub-pixel B of the first pixel group PG1, may be included in one pixel, and another part of this blue sub-pixel B may belong to another pixel.

The first pixel PX1 is disposed in the first pixel area PA1 and the second pixel PX2 is disposed in the second pixel area PA2.

In the embodiment shown, n ("n" is an odd number equal to or greater than 3) sub-pixels R, G, B, W, and R are disposed in the first and second pixel areas PA1, PA2 together. In the present exemplary embodiment, n is 5, and thus five sub-pixels R, G, B, W, and R are disposed in the first and second pixel areas PA1 and PA2.

Each of the sub-pixels R, G, B, W, and R is included in any one of the first to fourth pixel groups PG1 to PG4. In pixels PX1 and PX2, sub-pixel B (hereinafter, referred to as a shared sub-pixel) along the first direction DR1 lies within both the first and second pixel areas PA1 and PA2. That is, the shared sub-pixel B is disposed at a center portion of the sub-pixels R, G, B, W, and R included in the first and second pixels PX1 and PX2 and overlaps both the first and second pixel areas PA1 and PA2.

The first and second pixels PX1 and PX2 may share the shared sub-pixel B. In this case, the blue data applied to the shared sub-pixel B is generated on the basis of a first blue data corresponding to the first pixel PX1 among the input data RGB and a second blue data corresponding to the second pixel PX2 among the input data RGB.

Similarly, two pixels included in each of the second to fourth pixel groups PG2 to PG4 may share one shared sub-pixel. The shared sub-pixel of the first pixel group PG1 is the blue sub-pixel B, the shared sub-pixel of the second pixel group PG2 is the white sub-pixel W, the shared sub-pixel of the third pixel group PG3 is the red sub-pixel R, and the shared sub-pixel of the fourth pixel group PG4 is the green sub-pixel G.

That is, the display panel 100 includes the first to fourth pixel groups PG1 to PG4, each including two pixels adjacent to each other, and the two pixels PX1 and PX2 of each of the first to fourth pixel groups PG1 to PG4 share one sub-pixel.

The first and second pixels PX1 and PX2 are driven during the same horizontal scanning period (1h), which corresponds to a pulse-on period of one gate signal. That is, the first and second pixels PX1 and PX2 are connected to the same gate line and driven by the same gate signal. Similarly, the first and second pixel groups PG1 and PG2 may be driven during a first horizontal scanning period and the third and fourth pixel groups PG3 and PG4 may be driven during a second horizontal scanning period.

In the present exemplary embodiment, each of the first and second pixels PX1 and PX2 includes two and a half sub-pixels. In detail, the first pixel PX1 includes a red sub-pixel R, a green sub-pixel G, and a half of a blue sub-pixel B along the first direction DR1. The second pixel PX2 includes the other half of the blue sub-pixel B, a white sub-pixel W, and a red sub-pixel R along the first direction DR1.

In the present exemplary embodiment, the sub-pixels included in each of the first and second pixels PX1 and PX2 display three different colors. That is, in this embodiment, each pixel PXn is a three-color pixel. The first pixel PX1 displays red, green, and blue colors and the second pixel PX2 displays blue, white, and red colors.

In the present exemplary embodiment, the number of sub-pixels may be two and a half times greater than the number of pixels. For instance, the two pixels PX1 and PX2 include the five sub-pixels R, G, B, W, and R. In other words, the five sub-pixels R, G, B, W, and R are disposed in the first and second areas PA1 and PA2, along the first direction DR1.

Figure 3:
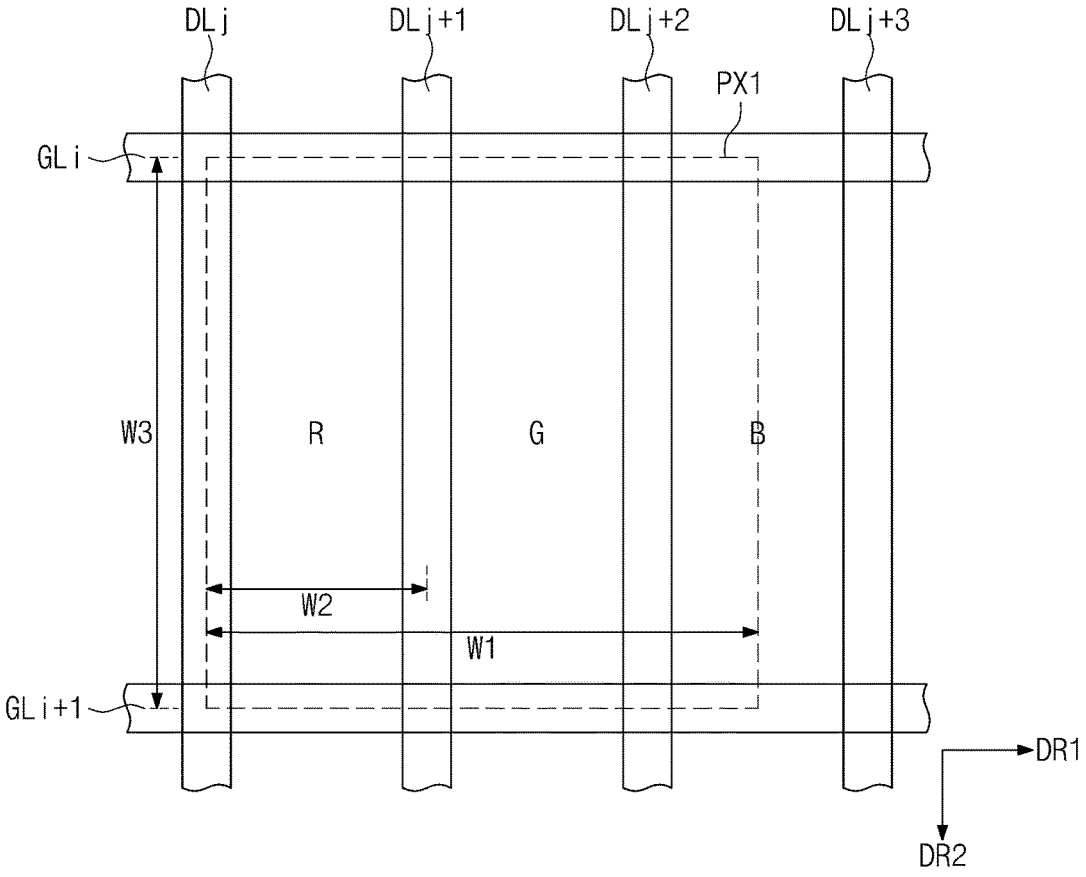
FIG. 3 is a partially enlarged view showing a first pixel and a peripheral area of the first pixel shown in FIG. 2.

FIG. 3 is a partially enlarged view showing a first pixel and a peripheral area of the first pixel shown in FIG. 2. FIG. 3 shows data lines DLj to DLj+3 ($1 \leq j < m$) adjacent to each other along the first direction DR1 and gate lines GLi and GLi+1 ($1 \leq i < k$) adjacent to each other along the second direction DR1. Although not shown in FIG. 3, a thin film transistor and an electrode connected to the thin film transistor may be disposed in areas partitioned by the data lines DLj to DLj+3 ($1 \leq j < m$) and the gate lines GLi and GLi+1 ($1 \leq i < k$).

Referring to FIGS. 2 and 3, each of the first and second pixels PX1 and PX2 has the aspect ratio of 1:1, i.e., the ratio of the length W1 along the first direction DR1 to the length W3 along the second direction DR2. Here, the term "substantially" means that the aspect ratio varies depending on factors such as a process condition or a device state. The first pixel PX1 will be described in further detail below, as being exemplary of both pixels PX1 and PX2.

The length W1 along the first direction DR1 of the first pixel PX1 is two and a half times greater than a distance W2 between a center in width of the j-th data line DLj along the first direction DR1 and a center in width of the (j+1)th data line DLj+1 along the first direction DR2. In other words, the length W1 along the first direction DR1 of the first pixel PX1 is equal to a sum of a distance between the center in width of the j-th data line DLj along the first direction DR1 and a center in width of the (j+2)th data line DLj+2 along the first direction DR1, plus a half of the distance between the center in width of the (j+2)th data line DLj+2 along the first direction DR1 and a center in width of the (j+3)th data line DLj+3 along the first direction DR1, but it should not be limited thereto or thereby. That is, the length W1 along the first direction DR1 of the first pixel PX1 may correspond to a half of a distance between the center in width of the j-th data line DLj along the first direction DR1 and a center in width of a (j+5)th data line along the first direction DR1.

The length W3 along the second direction DR2 of the first pixel PX1 is defined by a distance between a center in width of the i-th gate line GLi along the second direction DR2 and a center in width of the (i+1)th gate line GLi+1 along the second direction DR2, but it should not be limited thereto or thereby. That is, the length W3 along the second direction DR2 of the first pixel PX1 is defined by a half of a distance between the center in width of the i-th gate line GLi along the second direction DR2 and a center in width of the (i+2)th gate line along the second direction DR2.

Figure 4:
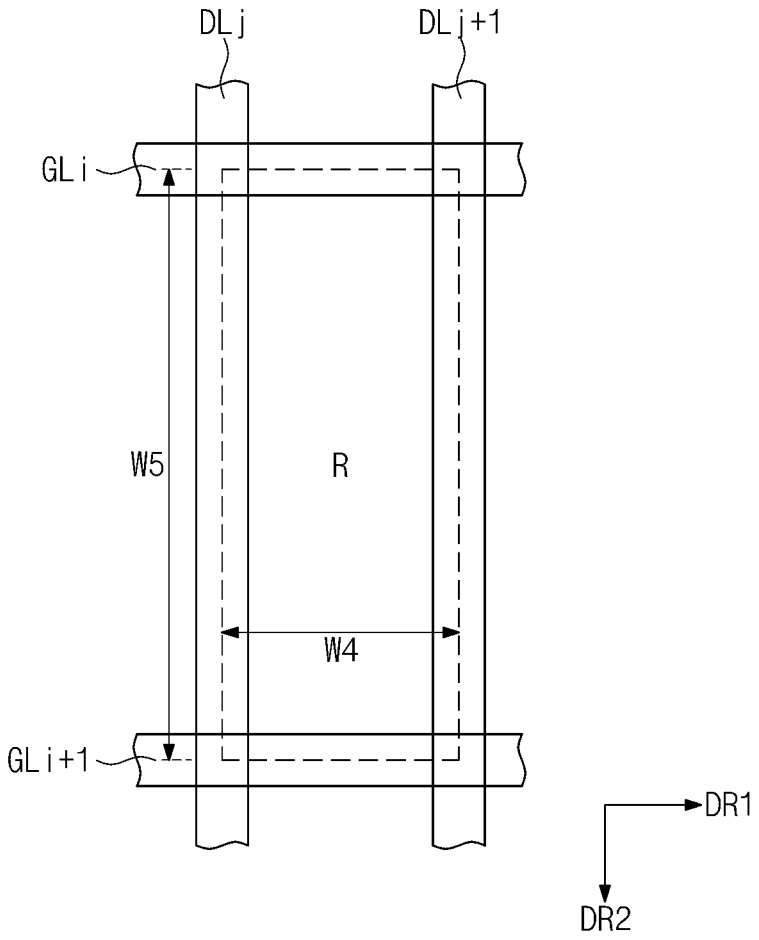
FIG. 4 is a partially enlarged view showing one sub-pixel, e.g., a red sub-pixel, and a peripheral area of the red sub-pixel shown in FIG. 2.

FIG. 4 is a partially enlarged view showing one sub-pixel, e.g., the red sub-pixel, and a peripheral area of the red sub-pixel shown in FIG. 2. FIG. 4 shows data lines DLj and DLj+1 ($1 \leq j < m$) adjacent to each other along the first direction DR1, and gate lines GLi and GLi+1 ($1 \leq i < k$) adjacent to each other along the second direction DR2. Although not shown in FIG. 4, a thin film transistor and an electrode connected to the thin film transistor may be disposed in areas partitioned by the data lines DLj and DLj+1 ($1 \leq j < m$) and the gate lines GLi and GLi+1 ($1 \leq i < k$).

Referring to FIGS. 2 and 4, each of the sub-pixels R, G, B, and W has an aspect ratio of 1:2.5, i.e., the ratio of the length W4 along the first direction DR1 to the length W5 along the second direction DR2. Here, the term "substantially" means that the aspect ratio can vary somewhat depending on factors such as a process condition or a device state. In the present exemplary embodiment, since the sub-pixels R, G, B, and W have largely the same structure and function, only the red sub-pixel R will be described in detail.

The length W4 along the first direction DR1 of the red sub-pixel R is defined by a distance W4 between a center in width of the j-th data line DLj along the first direction DR1 and a center in width of the (j+1)th data line DLj+1 along the first direction DR1, but it should not be limited thereto or thereby. That is, the length W4 along the first direction DR1 of the red sub-pixel R may be defined by a half of a distance between the center in width of the j-th data line DLj along the first direction DR1 and a center in width of the (j+2)th data line along the first direction DR1.

The length W5 along the second direction DR2 of the red sub-pixel R is defined by a distance between a center in width of the i-th gate line GLi along the second direction DR2 and a center in width of the (i+1)th gate line GLi+1 along the second direction DR2, but it should not be limited thereto or thereby. That is, the length W5 along the second direction DR2 of the red sub-pixel R may be defined by a half of a distance between the center in width of the i-th gate line GLi along the second direction DR2 and a center in width of the (i+2)th gate line along the second direction DR2.

Referring to FIGS. 2 to 4 again, the sub-pixels arranged in two rows by five columns may have a substantially square shape. That is, the sub-pixels included in the first and third pixel groups PG1 and PG3 collectively may have a square shape.

In addition, each of the first to fourth pixel groups PG1 to PG4 has an aspect ratio of 2:1. When explaining the first pixel group PG1 as a representative example, the first pixel group PG1 includes n (n is an odd number equal to or larger than 3) sub-pixels R, G, B, W, and R. Each of the sub-pixels R, G, B, W, and R included in the first pixel group PG1 has an aspect ratio of 2:n. Since the "n" is 5 in the exemplary embodiment shown in FIG. 2, the aspect ratio of each of the sub-pixels R, G, B, W, and R is 1:2.5.

According to the display apparatus of the present disclosure, since the one pixel includes two and a half (2.5) sub-pixels, the number of data lines in the display apparatus may be reduced by a factor of ⅚ relative to a conventional RGB stripe display, even though the display apparatus displays the same resolution as that of the RGB stripe structure. When the number of the data lines is reduced, the circuit configuration of the data driver 400 (refer to FIG. 1) becomes simpler, and thus a manufacturing cost of the data driver 400 is reduced. In addition, the aperture ratio of the display apparatus is increased since the number of data lines is reduced.

Further, according to the display apparatus of the present disclosure, one pixel displays three colors. Therefore, the display apparatus may have improved color reproducibility even though the display apparatus has the same resolution as that of a structure in which one pixel includes two sub-pixels from among red, green, blue, and white sub-pixels R, G, B, and W.

Figure 5:
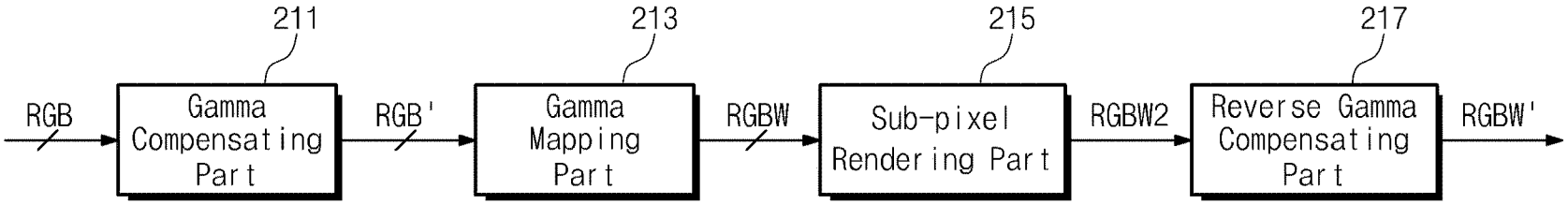
FIG. 5 is a block diagram showing a timing controller shown in FIG. 1.

FIG. 5 is a block diagram showing the timing controller 200 shown in FIG. 1.

Referring to FIG. 5, the timing controller 200 includes a gamma compensating part 211, a gamut mapping part 213, a sub-pixel rendering part 215, and a reverse gamma compensating part 217.

The gamma compensating part 211 receives input data RGB including red, green, and blue data. In general, the input data RGB have a non-linear characteristic. The gamma compensating part 211 applies a gamma function to the input data RGB to allow the input data RGB to be linearized. The gamma compensating part 211 generates the linearized input data RGB' on the basis of the input data RGB having the non-linear characteristic, such that the data is easily processed by subsequent blocks, e.g., the gamut mapping part 213 and the sub-pixel rendering part 215. The linearized input data RGB' is applied to the gamut mapping part 213.

The gamut mapping part 213 generates RGBW data RGBW having red, green, blue, and white data on the basis of the linearized input data RGB'. The gamut mapping part 213 maps an RGB gamut of the input data RGB' linearized by a gamut mapping algorithm (GMA) to an RGBW gamut and generates the RGBW data RGBW. The RGBW data RGBW is applied to the sub-pixel rendering part 215.

Although not shown in FIG. 5, the gamut mapping part 213 may further generate a brightness data of the linearized input data RGB' in addition to the RGBW data RGBW. The brightness data is applied to the sub-pixel rendering part 215 and used for a sharpening filtering process.

The sub-pixel rendering part 215 performs a rendering operation on the RGBW data RGBW to generate rendering data RGBW2 respectively corresponding to the sub-pixels R, G, B, and W. The RGBW data RGBW include data about four colors configured to include red, green, blue, and white colors corresponding to each pixel area. However, in the present exemplary embodiment, since one pixel includes two and a half sub-pixels including the share sub-pixel and displaying three different colors, the rendering data RGBW2 may only include data for three colors among the red, green, blue, and white colors.

The rendering operation performed by the sub-pixel rendering part 215 is configured to include a re-sample filtering process and a sharpening filtering operation. The re-sample filtering operation modifies the color of the target pixel, on the basis of color values of the target pixel and neighboring pixels disposed adjacent to the target pixel. The sharpening filtering operation detects shape of the image, e.g., lines, edges, dots, diagonal lines, etc., and position of the RGBW data RGBW, and compensates for the RGBW data RGBW on the basis of the detected data. Hereinafter, the re-sample filter operation will be mainly described.

The rendering data RGBW2 is applied to the reverse gamma compensating part 217. The reverse gamma compensating part 217 performs a reverse gamma compensation operation on the rendering data RGBW2, to convert the rendering data RGBW2 to non-linearized RGBW data RGBW'. The data format of the non-linearized RGBW data RGBW' is converted to an output data RGBWf by taking a specification of the data driver 400 into consideration in known manner, and the output data RGBWf is applied to the data driver 400.

Figure 6:
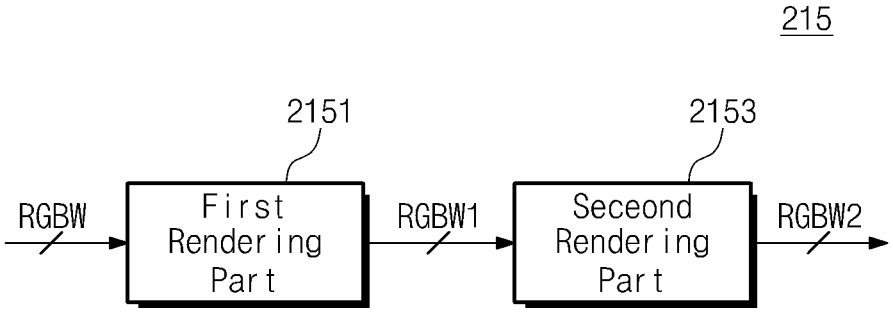
FIG. 6 is a block diagram showing a sub-pixel rendering part shown in FIG. 5.

FIG. 6 is a block diagram showing the sub-pixel rendering part 215 shown in FIG. 5.

Referring to FIG. 6, the sub-pixel rendering part 215 includes a first rendering part 2151 and a second rendering part 2153.

The first rendering part 2151 generates an intermediate rendering data RGBW1 corresponding to the sub-pixels of each pixel on the basis of the RGBW data RGBW using a re-sample filter. The RGBW data RGBW includes red, green, blue, and white data corresponding to each pixel area. The intermediate rendering data RGBW1 includes two normal sub-pixel data and a shared sub-pixel data, which collectively correspond to a pixel area. The shared sub-pixel data is area portion of the image data for the shared sub-pixel.

In each pixel, since an area of the shared sub-pixel is smaller than an area of a normal (non-shared) sub-pixel, a maximum grayscale value of the portion of the shared sub-pixel data corresponding to each pixel may be smaller than a maximum grayscale value of the normal sub-pixel data. The grayscale of the portion of the shared sub-pixel data and the grayscale of the normal sub-pixel data may be determined by a scale coefficient of the re-sample filter.

Hereinafter, the rendering operation of the first rendering part 2151 will be described in detail with reference to FIGS. 7 to 11C.

Figure 7:
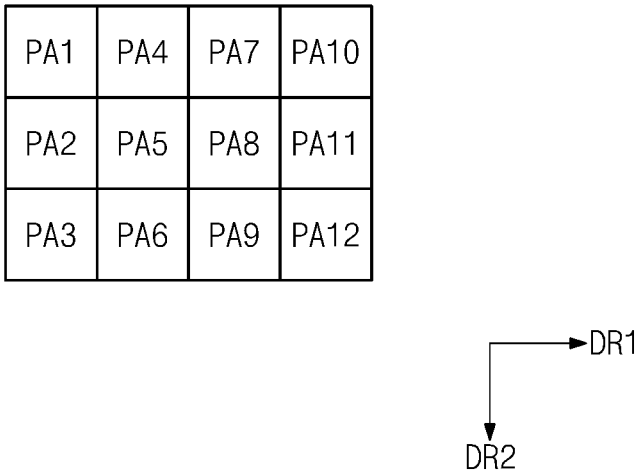
FIG. 7 is a view showing pixel areas arranged in three rows by four columns according to an exemplary embodiment of the present disclosure.
Figure 8:
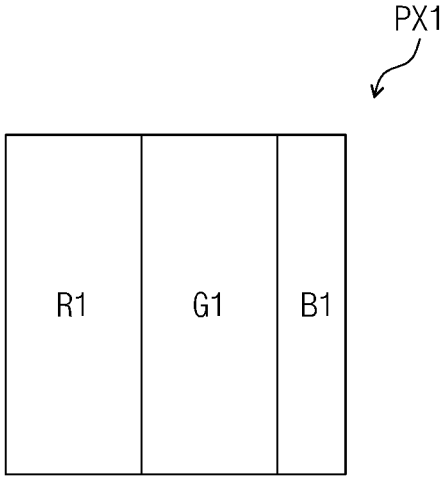
FIG. 8 is a view showing a first pixel disposed in a fifth pixel area shown in FIG. 7.

FIG. 7 is a view showing pixel areas arranged in three rows by four columns, according to an exemplary embodiment of the present disclosure; FIG. 8 is a view showing a first pixel disposed in the fifth pixel area shown in FIG. 7; and FIGS. 9A to 9C are views showing a re-sample filter used to generate the first pixel data shown in FIG. 8.

FIG. 8 shows the first pixel PX1 configured to include a red sub-pixel R1, a green sub-pixel G1, and a blue sub-pixel B1 as a representative example. The red sub-pixel R1 may be referred to as a first normal sub-pixel, the green sub-pixel G1 may be referred to as a second normal sub-pixel, and the blue sub-pixel B1 may be referred to as a first shared sub-pixel.

Each of a red sub-pixel R1 (first normal sub-pixel) and a green sub-pixel G1 (second normal sub-pixel) is included in the first pixel PX1 as an independent sub-pixel. The blue sub-pixel B1 (first shared sub-pixel) corresponds to a portion of the shared sub-pixel. The blue sub-pixel B1 does not serve as an independent sub-pixel and is to process the data of the portion of the shared sub-pixel included in the first pixel PX1. That is, the blue sub-pixel B1 of the first pixel PX1 forms one independent shared sub-pixel together with a blue sub-pixel B2 of the second pixel PX2.

Hereinafter, the data of the intermediate rendering data RGBW1, which corresponds to the first pixel PX1, is referred to as a first pixel data. The first pixel data is configured to include a first normal sub-pixel data corresponding to the first normal sub-pixel R1, a second normal sub-pixel data corresponding to the second normal sub-pixel G1, and a first shared sub-pixel data corresponding to the first shared sub-pixel B1.

Referring to FIGS. 7 and 8, the first pixel data is generated from the RGBW data for that pixel and all immediately-surrounding pixels. That is, for pixel area PA5 of FIG. 7, the first pixel data is generated on the basis of the data among the RGBW data RGBW, which corresponds to the fifth pixel area PA5 in which the first pixel PX1 is disposed and the pixel areas PA1 to PA4 and PA6 to PA9 surrounding the fifth pixel area PA5.

The first to ninth pixel areas PA1 to PA9 are disposed at positions respectively defined by a first row and a first column, a second row and the first column, a third row and the first column, the first row and a second column, the second row and the second column, the third row and the second column, the first row and a third column, the second row and the third column, and the third row and the third column.

In the present exemplary embodiment, the first pixel data may be generated on the basis of the data corresponding to the first to ninth pixel areas PA1 to PA9, but the number of the pixel areas should not be limited thereto or thereby. For example, the first pixel data may be generated on the basis of the data corresponding to ten or more pixel areas.

The re-sample filter includes a first normal re-sample filter RF1 (referring to FIG. 9A), a second normal re-sample filter GF1 (referring to FIG. 9B), and a first shared re-sample filter BF1 (referring to FIG. 9C). The scale coefficient of the re-sample filter indicates a proportion of the RGBW data RGBW corresponding to each pixel area among one sub-pixel data. The scale coefficient of the re-sample filter is equal to or greater than zero (0) and smaller than one (1).

FIG. 9A shows the first normal re-sample filter RF1 used to generate the first normal sub-pixel data of the first pixel data.

Referring to FIG. 9A, the scale coefficients of the first normal re-sample filter RF1 in the first to ninth pixel areas PA1 to PA9 are 0, 0.125, 0, 0.0625, 0.625, 0.0625, 0.0625, 0, and 0.0625, respectively.

The first rendering part 2151 multiplies the red data of the RGBW data RGBW, which correspond to the first to ninth pixel areas PA1 to PA9, by the scale coefficients in corresponding positions of the first normal re-sample filter RF1. For instance, the red data corresponding to the first pixel area PA1 is multiplied by the scale coefficient, e.g., 0, of the first normal re-sample filter RF1 corresponding to the first pixel area PA1, and the red data corresponding to the second pixel area PA2 is multiplied by the scale coefficient, e.g., 0.125, of the first normal re-sample filter RF1 corresponding to the second pixel area PA2. Similarly, the red data corresponding to the ninth pixel area PA9 is multiplied by the scale coefficient, e.g., 0.0625, of the first normal re-sample filter RF1 corresponding to the ninth pixel area PA9.

The first rendering part 2151 calculates a sum of the values obtained by multiplying the red data of the first to ninth pixel areas PA1 to PA9 by the scale coefficients of the first normal re-sample filter RF1, and this sum is designated as the first normal sub-pixel data for the first normal sub-pixel R1 of the first pixel PX1.

FIG. 9B shows the second normal re-sample filter GF1 used to generate the second normal sub-pixel data of the first pixel data.

Referring to FIG. 9B, the scale coefficients of the second normal re-sample filter GF1 in the first to ninth pixel areas PA1 to PA9 are 0, 0, 0, 0.125, 0.625, 0.125, 0, 0.125, and 0, respectively.

The first rendering part 2151 multiplies the green data of the RGBW data RGBW for the first to ninth pixel areas PA1 to PA9, by the scale coefficients in corresponding positions of the second normal re-sample filter GF1. It then calculates a sum of the multiplied values as the second normal sub-pixel data for the second normal sub-pixel G1. The rendering operation that calculates the second normal sub-pixel data is substantially similar to that of the first normal sub-pixel data, and thus details thereof will be omitted.

FIG. 9C shows the first shared re-sample filter BF1 used to generate the first shared sub-pixel data of the first pixel data.

Referring to FIG. 9C, the scale coefficients of the first shared re-sample filter BF1 in the first to ninth pixel areas PA1 to PA9 are 0.0625, 0, 0.0625, 0, 0.25, 0, 0, 0.125, and 0, respectively.

The first rendering part 2151 multiplies the blue data of the RGBW data RGBW, which correspond to the first to ninth pixel areas PA1 to PA9, by the scale coefficients in corresponding positions of the first shared re-sample filter BF1. It then calculates a sum of the multiplied values as the first shared sub-pixel data for the first shared sub-pixel B1. The rendering operation that calculates the first shared sub-pixel data is substantially similar to that of the first normal sub-pixel data, and thus details thereof will be omitted.

Figure 10:
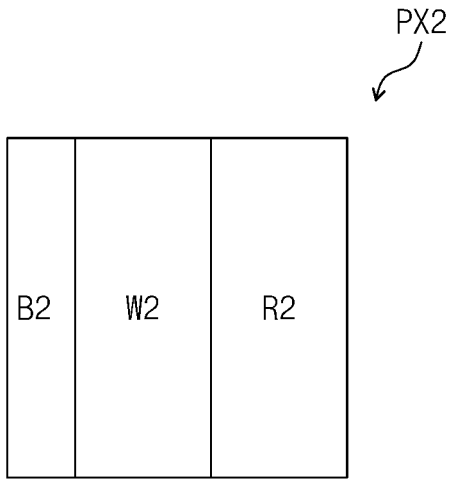
FIG. 10 is a view showing a second pixel disposed in an eighth pixel area shown in FIG. 7.

FIG. 10 is a view showing the second pixel disposed in the eighth pixel area shown in FIG. 7, and FIGS. 11A to 11C are views showing a re-sample filter used to generate a second pixel data shown in FIG. 10.

FIG. 10 shows the second pixel PX2 configured to include a blue sub-pixel B2, a white sub-pixel W2, and a red sub-pixel R2 as a representative example. The white sub-pixel W2 may be referred to as a third normal sub-pixel, the red sub-pixel R2 may be referred to as a fourth normal sub-pixel, and the blue sub-pixel B2 may be referred to as a second shared sub-pixel.

Each of a white sub-pixel W2 (third normal sub-pixel) and a red sub-pixel R2 (fourth normal sub-pixel) is included in the second pixel PX2 as an independent sub-pixel. The blue sub-pixel B2 (second shared sub-pixel) corresponds to a remaining portion of the independent shared blue sub-pixel B1 of the first pixel PX1. The blue sub-pixel B2 of the second pixel PX2 forms the independent shared sub-pixel together with the blue sub-pixel B1 of the first pixel PX1.

Hereinafter, the data of the intermediate rendering data RGBW1, which corresponds to the second pixel PX2, is referred to as a first pixel data. The second pixel data is configured to include a second shared sub-pixel data corresponding to the second shared sub-pixel B2, a third normal sub-pixel data corresponding to the third normal sub-pixel W2, and a fourth normal sub-pixel data corresponding to the fourth normal sub-pixel R2.

Referring to FIGS. 7 and 10, the second pixel data is generated on the basis of the data among the RGBW data RGBW, which corresponds to the eighth pixel area PA8 in which the second pixel PX2 is disposed, as well as the pixel areas PA4 to PA7 and PA9 to PA12 surrounding the eighth pixel area PA8.

The fourth to twelfth pixel areas PA4 to PA12 are disposed at positions respectively defined by a first row and a first column, a second row and the first column, a third row and the first column, the first row and a second column, the second row and the second column, the third row and the second column, the first row and a third column, the second row and the third column, and the third row and the third column.

In the present exemplary embodiment, the second pixel data may be generated on the basis of the data corresponding to the fourth to twelfth pixel areas PA4 to PA12, but the number of the pixel areas should not be limited thereto or thereby. The second pixel data may be generated on the basis of the data corresponding to any pixels and any number of pixels, for example ten or more pixel areas.

The re-sample filter includes a second shared re-sample filter BF2 (referring to FIG. 11A), a third normal re-sample filter WF2 (referring to FIG. 11B), and a fourth normal re-sample filter RF2 (referring to FIG. 11C). The scale coefficient of the re-sample filter indicates a proportion of the RGBW data RGBW corresponding to each pixel area among one sub-pixel data. The scale coefficient of the re-sample filter is equal to or greater than zero (0) and smaller than one (1).

FIG. 11A shows the second shared re-sample filter BF2 used to generate the second shared sub-pixel data of the second pixel data.

Referring to FIG. 11A, the scale coefficients of the second shared re-sample filter BF2 in the fourth to twelfth pixel areas PA4 to PA12 are 0, 0.125, 0, 0, 0.25, 0, 0.0625, 0, and 0.0625, respectively.

The first rendering part 2151 multiplies the blue data of the RGBW data RGBW, which correspond to the fourth to twelfth pixel areas PA4 to PA12, by the scale coefficients in corresponding positions of the second shared re-sample filter BF2. It then calculates a sum of the multiplied values as the second shared sub-pixel data for the second shared sub-pixel B2. The rendering operation that calculates the second shared sub-pixel data is substantially similar to that of the first shared sub-pixel data of the first pixel data, and thus details thereof will be omitted.

FIG. 11B shows the third normal re-sample filter WF2 used to generate the third normal sub-pixel data of the second pixel data.

Referring to FIG. 11B, the scale coefficients of the third normal re-sample filter WF2 in the fourth to twelfth pixel areas PA4 to PA12 are 0, 0.125, 0, 0.125, 0.625, 0.125, 0, 0, and 0, respectively.

The first rendering part 2151 multiplies the white data of the RGBW data RGBW, which correspond to the fourth to twelfth pixel areas PA4 to PA12, by the scale coefficients in corresponding positions of the third normal re-sample filter WF2. It then calculates a sum of the multiplied values as the third normal sub-pixel data for the third normal sub-pixel W2. The rendering operation that calculates the third normal sub-pixel data is substantially similar to that of the first normal sub-pixel data of the first pixel data, and thus details thereof will be omitted.

FIG. 11C shows the fourth normal re-sample filter RF2 used to generate the third normal sub-pixel data of the second pixel data.

Referring to FIG. 11C, the scale coefficients of the fourth normal re-sample filter RF2 in the fourth to twelfth pixel areas PA4 to PA12 are 0.0625, 0, 0.0625, 0.0625, 0.625, 0.0625, 0, 0.125, and 0, respectively.

The first rendering part 2151 multiplies the red data of the RGBW data RGBW, which correspond to the fourth to twelfth pixel areas PA4 to PA12, by the scale coefficients in corresponding positions of the fourth normal re-sample filter RF2. It then calculates a sum of the multiplied values as the fourth normal sub-pixel data for the fourth normal sub-pixel R2. The rendering operation that calculates the fourth normal sub-pixel data is substantially similar to that of the first normal sub-pixel data of the first pixel data, and thus details thereof will be omitted.

In the present exemplary embodiment, the scale coefficients of the re-sample filter are determined by taking the area of the corresponding sub-pixel in each pixel into consideration. Hereinafter, the first and second pixels PX1 and PX2 will be described as a representative example.

In the first pixel PX1, the area of each of the first and second normal sub-pixels R1 and G1 is greater than that of the shared half of the first shared sub-pixel B1. In detail, the area of each of the first and second normal sub-pixels R1 and G1 is two times greater than that of the shared portion of the first shared sub-pixel B1 in the first pixel PX1.

A sum of the scale coefficients of the first shared re-sample filter BF1 may be a half of the sum of the scale coefficients of the first normal re-sample filter RF1. In addition, a sum of the scale coefficients of the first shared re-sample filter BF1 may be a half of the sum of the scale coefficients of the second normal re-sample filter GF1.

thus, in the embodiment of FIGS. 9A to 9C, the sum of the scale coefficients of each of the first and second normal re-sample filters RF1 and GF1 is 1 and the sum of the scale coefficients of the first shared re-sample filter BF1 is 0.5.

Accordingly, the maximum grayscale of the first shared sub-pixel data corresponds to a half of the maximum grayscale of each of the first and second normal sub-pixel data.

Similarly, in the second pixel PX2, the area of each of the third and fourth normal sub-pixels W2 and R2 is greater than that part of the second shared sub-pixel B2 that lies within pixel PX2. In detail, the area of each of the third and fourth normal sub-pixels W2 and R2 is two times greater than that of the second shared sub-pixel B2 within the second pixel PX2.

A sum of the scale coefficients of the second shared re-sample filter BF2 may be a half of the sum of the scale coefficients of the third normal re-sample filter WF2. In addition, a sum of the scale coefficients of the second shared re-sample filter BF2 may be a half of the sum of the scale coefficients of the fourth normal re-sample filter RF2.

In the embodiment of FIGS. 11A to 11C, the sum of the scale coefficients of each of the third and fourth normal re-sample filters WF2 and RF2 is 1 and the sum of the scale coefficients of the second shared re-sample filter BF2 is 0.5.

Therefore, the maximum grayscale of the second shared sub-pixel data corresponds to a half of the maximum grayscale of each of the third and fourth normal sub-pixel data.

Referring to FIGS. 6 to 8 and 10 again, the second rendering part 2153 calculates the first and second shared sub-pixel data of the intermediate rendering data RGBW1 to generate a shared sub-pixel data. The shared sub-pixel data corresponds to one independent shared sub-pixel configured to include the first and second shared sub-pixels B1 and B2.

The second rendering part 2153 may generate the shared sub-pixel data by adding the first shared sub-pixel data of the first pixel data and the second shared sub-pixel data of the second pixel data.

A maximum grayscale of the data for the shared sub-pixel, i.e., the blue sub-pixel B1 of the first pixel PX1 and the blue sub-pixel B2 of the second pixel PX2, may be substantially the same as the maximum grayscale of the data of each of the first to fourth normal sub-pixels R, G1, W2, and R2. Adding the sum of the scale coefficients of the first shared re-sample filter BF1 applied to the first pixel PX1 and the sum of the scale coefficients of the second shared re-sample filter BF2 produces 1, and a sum of the scale coefficients of other re-sample filters RF1, GF1, WF2, and RF2 is each also 1.

The second rendering part 2153 outputs the data for the first to fourth normal sub-pixels R1, G1, W2, and R2 and the shared sub-pixel data as the rendering data RGBW2.

Figure 12:
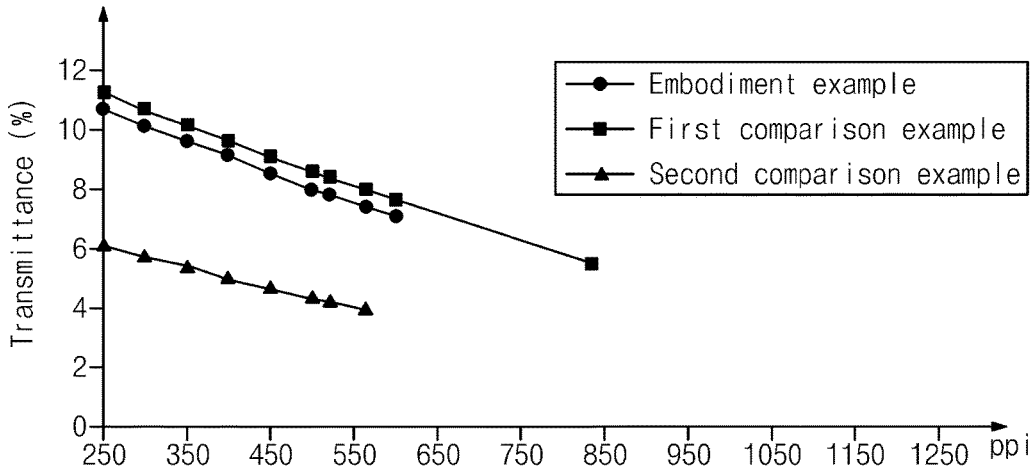
FIG. 12 is a graph showing a transmittance as a function of a pixel density, i.e., a pixel per inch (ppi), of the display apparatus including the display panel shown in FIG. 2, a first comparison example, and a second comparison example.

FIG. 12 is a graph showing a transmittance as a function of a pixel density (hereinafter, referred to as a pixel per inch (ppi)), for the display apparatus including the display panel shown in FIG. 2, a first comparison example, and a second comparison example. The following Table 1 shows the transmittance as a function of ppi for the display apparatus including the display panel shown in FIG. 2, the first comparison example, and the second comparison example.

TABLE 1

| | | ppi | | | | | | | | | |
|---|---|---|---|---|---|---|---|---|---|---|---|
| | | 250 | 299 | 350 | 399 | 450 | 500 | 521 | 564 | 600 | 834 |
| Transmittance (%) | Embodiment example | 10.6 | 10.0 | 9.4 | 8.9 | 8.3 | 7.8 | 7.6 | 7.1 | 6.8 | |
| | First comparison example | 10.8 | 10.2 | 9.7 | 9.2 | 8.7 | 8.2 | 8.0 | 7.5 | 7.2 | 5.0 |
| | Second comparison example | 6.12 | 5.75 | 5.39 | 5.05 | 4.70 | 4.38 | 4.25 | 3.98 | | |

In FIG. 12 and Table 1, the first comparison example indicates a structure in which one pixel is configured to include two RGBW sub-pixels along the first direction DR1, and the second comparison example indicates an RGB stripe structure in which one pixel is configured to include three sub-pixels along the first direction DR1.

In FIG. 12 and Table 1, a maximum ppi of the embodiment example, the first comparison example, and the second comparison example indicates a value measured when a process threshold value in a short side (a length along the first direction DR1 of each sub-pixel in the display panel shown in FIG. 2) of each sub-pixel is set to about 15 micrometers.

Referring to FIG. 12 and Table 1, the display apparatus including the display panel shown in FIG. 2 has a maximum ppi higher than that of the second comparison example under comparable conditions. As an example, the display apparatus according to the present disclosure has a maximum ppi of about 600 and the second comparison example has a maximum ppi of about 564.

In addition, when the display apparatus of the embodiment example has substantially the same maximum ppi as that of the second comparison example, the display apparatus has transmittance higher than that of the second comparison example. When each of the display apparatuses of the embodiment example and the second comparison example has a ppi of about 564, the display apparatus of the embodiment example has a transmittance of about 7.1% and the second comparison example has a transmittance of about 3.98%.

As described above, since one pixel displays three colors in the display apparatus of the embodiment example, the display apparatus of the embodiment example may have a color reproducibility higher than that of the first comparison example.

Figure 13:
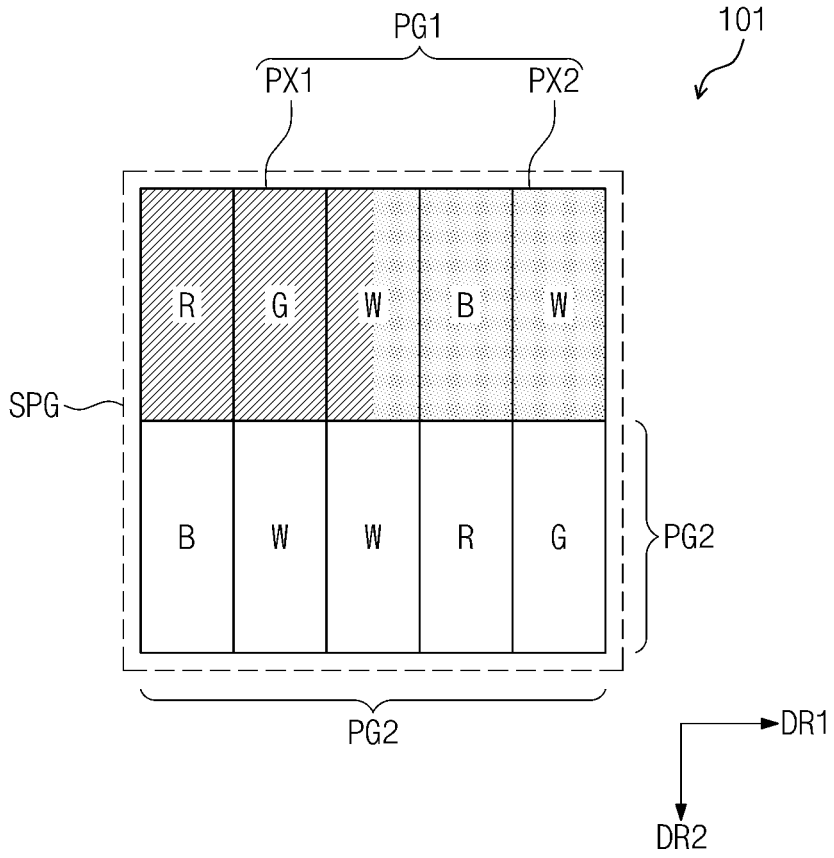
FIGS. 13, 14, 15, 16, and 17 are views showing a portion of display panels according to other exemplary embodiments of the present disclosure.

FIG. 13 is a view showing a portion of a display panel 101 according to another exemplary embodiment of the present disclosure.

The display panel 101 shown in FIG. 13 has substantially the same structure and function as those of the display panel 100 shown in FIG. 2, except for the difference in color arrangement of the sub-pixels. Hereinafter, features of the display panel 101 shown in FIG. 13 that differ from the display panel 100 shown in FIG. 2 will mainly be described.

As shown in FIG. 13, the sub-pixels R, G, B, and W are repeatedly arranged within the sub-pixel group SPG, which is configured to include ten sub-pixels arranged in two rows by five columns. The sub-pixel group SPG includes two red sub-pixels, two green sub-pixels, two blue-sub pixels, and four white sub-pixels.

The sub-pixels arranged in the first row of the sub-pixel group SPG are arranged in order of a red sub-pixel R, a green sub-pixel G, a white sub-pixel W, a blue sub-pixel B, and a white sub-pixel W along the first direction DR1. In addition, the sub-pixels arranged in the second row of the sub-pixel group SPG are arranged in order of a blue sub-pixel B, a white sub-pixel W, a white sub-pixel W, a red sub-pixel R, and a green sub-pixel G along the first direction DR1. However, the arrangement order of the sub-pixels should not be limited to the above-mentioned orders.

The shared sub-pixel in the first pixel group PG1 displays a white color and the shared sub-pixel in the second pixel group PG2 also displays a white color. That is, the shared sub-pixel of the display panel 101 shown in FIG. 13 may be a white sub-pixel displaying a white color.

According to the display panel 101 shown in FIG. 13, the number of white sub-pixels is increased compared with that of the display panel 100 shown in FIG. 2, and thus the overall brightness of the display panel 101 may be improved. In addition, since two pixels of each pixel group share a white sub-pixel in the display panel 101 shown in FIG. 13, the area of the white sub-pixel in each pixel is decreased compared with structures in which one pixel includes two RGBW sub-pixels. Accordingly, a ratio of the white color to the yellow color (Y/W) may be prevented from decreasing since the white sub-pixel is added to the sub-pixel group SPG.

Figure 14:
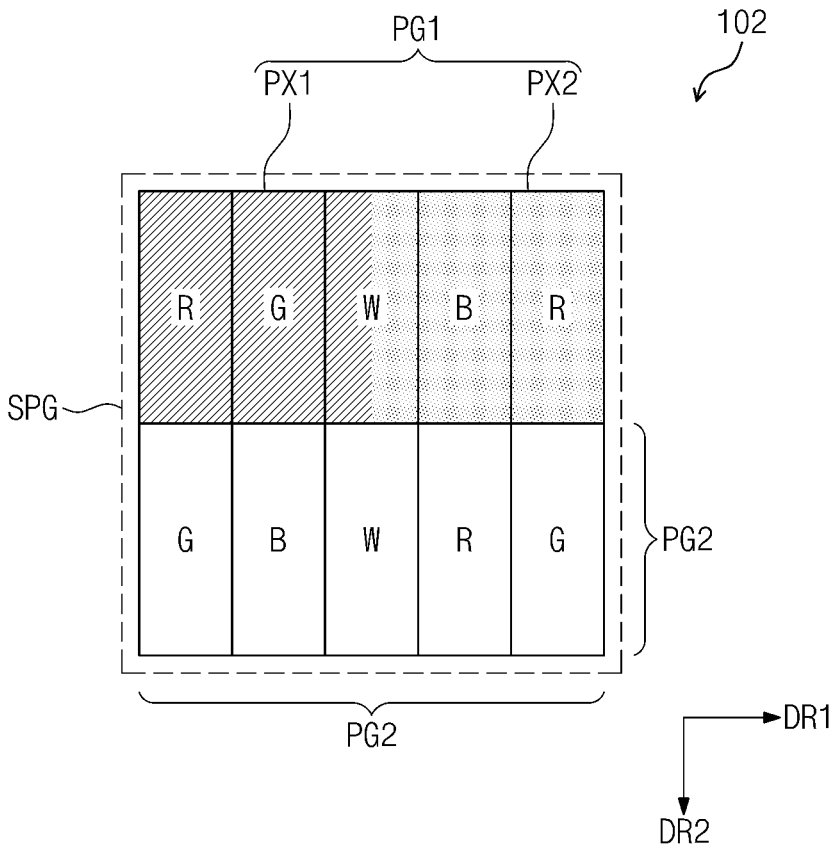

FIG. 14 is a view showing a portion of a display panel 102 according to another exemplary embodiment of the present disclosure.

The display panel 102 shown in FIG. 14 has substantially the same structure and function as those of the display panel 100 shown in FIG. 2, except for the difference in color arrangement of the sub-pixels. Hereinafter, features of the display panel 102 shown in FIG. 14 that differ from those of the display panel 100 shown in FIG. 2 will mainly be described.

As shown in FIG. 14, the sub-pixels R, G, B, and W are repeatedly arranged within sub-pixel group SPG, which is configured to include ten sub-pixels arranged in two rows by five columns. The sub-pixel group SPG includes three red sub-pixels, three green sub-pixels, two blue-sub pixels, and two white sub-pixels.

The sub-pixels arranged in the first row of the sub-pixel group SPG are arranged in order of a red sub-pixel R, a green sub-pixel G, a white sub-pixel W, a blue sub-pixel B, and a red sub-pixel R along the first direction DR1. In addition, the sub-pixels arranged in the second row of the sub-pixel group SPG are arranged in order of a green sub-pixel G, a blue sub-pixel B, a white sub-pixel W, a red sub-pixel R, and a green sub-pixel G along the first direction DR1. However, the arrangement order of the sub-pixels should not be limited to that shown.

The shared sub-pixel in the first pixel group PG1 displays a white color and the shared sub-pixel in the second pixel group PG2 also displays a white color. That is, the shared sub-pixel of the display panel 102 shown in FIG. 14 may be a white sub-pixel displaying a white color.

According to the display panel 102 shown in FIG. 14, since two pixels of each pixel group share a white sub-pixel in the display panel 102 shown in FIG. 14, the area of the white sub-pixel in each pixel is decreased compared with structures in which one pixel includes two RGBW sub-pixels. Accordingly, a ratio of the white color to the yellow color (Y/W) may be prevented from decreasing since the white sub-pixel is added to the sub-pixel group SPG.

Human eye color perception and resolution decreases in color order of green, red, blue, and white, i.e., green>red>blue>white. Thus, in the display panel 102 shown in FIG. 14, the red and green sub-pixels are more prevalent in the display panel 102 than are the blue and white sub-pixels, and thus the perception of resolution against the colors of the display apparatus 102 may be improved.

Figure 15:
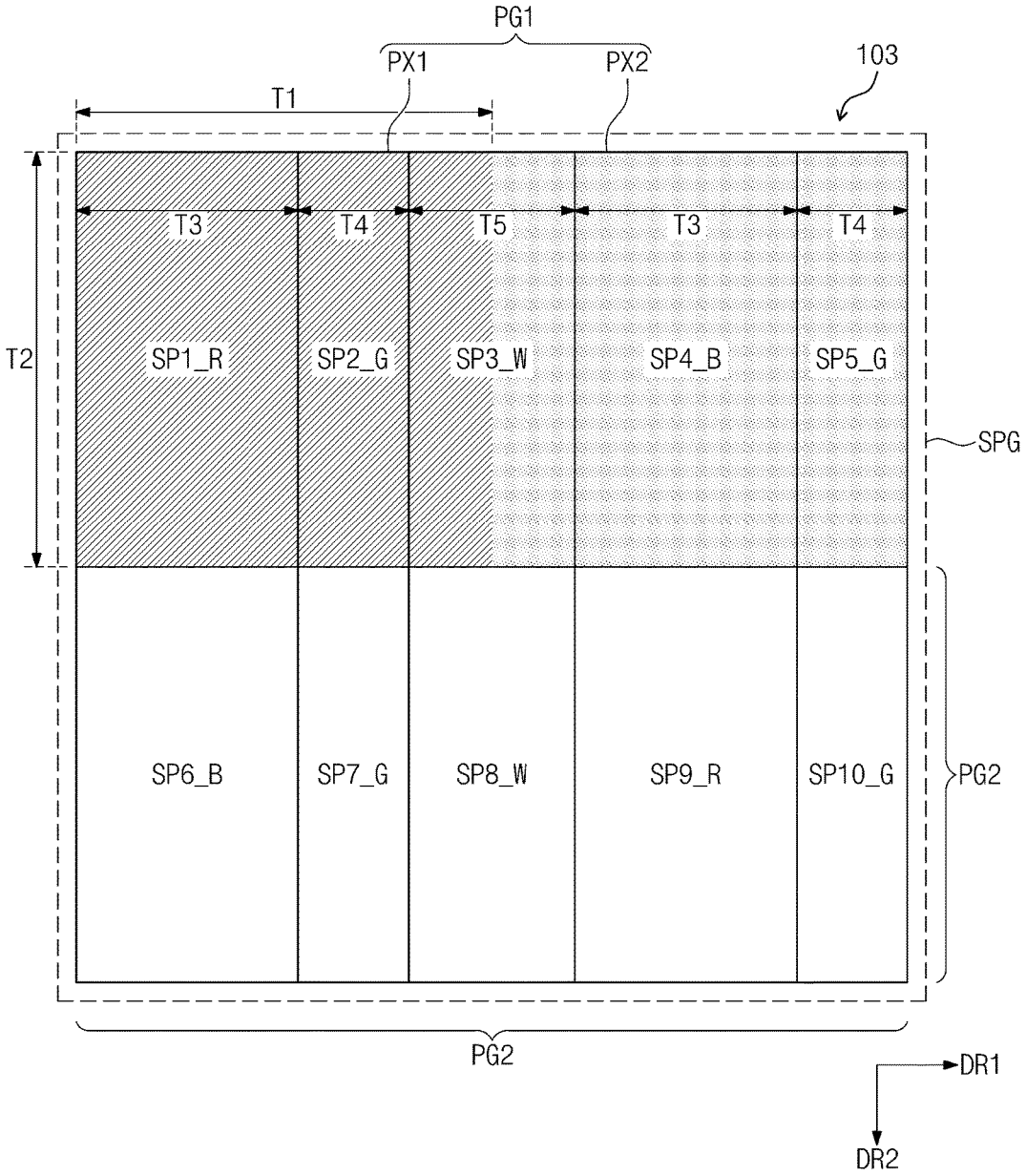

FIG. 15 is a view showing a portion of a display panel 103 according to another exemplary embodiment of the present disclosure.

The display panel 103 shown in FIG. 15 has substantially the same structure and function as those of the display panel 100 shown in FIG. 2, except for the difference in color arrangement and shape of the sub-pixels. Hereinafter, features of the display panel 103 shown in FIG. 15 that differ from those of the display panel 100 shown in FIG. 2 will mainly be described.

Referring to FIG. 15, sub-pixels SP1_R to SP10_G are repeatedly arranged within sub-pixel group SPG, which is configured to include ten sub-pixels arranged in two rows by five columns. The sub-pixel group SPG includes two red sub-pixels, four green sub-pixels, two blue-sub pixels, and two white sub-pixels.

In FIG. 15, the sub-pixels arranged in the first row of the sub-pixel group SPG are arranged in order of a first sub-pixel SP1_R, a second sub-pixel SP2_G, a third sub-pixel SP3_W, a fourth sub-pixel SP4_B, and a fifth sub-pixel SP5_G along the first direction DR1. The first sub-pixel SP1_R displays a red color, the second sub-pixel SP2_G displays a green color, the third sub-pixel SP3_W displays a white color, the fourth sub-pixel SP4_B displays a blue color, and the fifth sub-pixel SP5_G displays a green color.

In addition, the sub-pixels arranged in the second row of the sub-pixel group SPG are arranged in order of a sixth sub-pixel SP6_B, a seventh sub-pixel SP7_G, an eighth sub-pixel SP8_W, a ninth sub-pixel SP9_R, and a tenth sub-pixel SP10_G along the first direction DR1. The sixth sub-pixel SP6_B displays a blue color, the seventh sub-pixel SP7_G displays a green color, the eighth sub-pixel SP8_W displays a white color, the ninth sub-pixel SP9_R displays a red color, and the tenth sub-pixel SP10_G displays a green color. However, the arrangement order of the colors of the first to tenth sub-pixels SP1_R to SP10_G should not be limited to that shown.

The display panel 103 includes pixel groups PG1 and PG2, each including two pixels adjacent to each other. FIG. 15 shows two pixel groups as a representative example. The pixel groups PG1 and PG2 have substantially the same structure except for the difference in color arrangement of the sub-pixels thereof. Hereinafter, the first pixel group PG1 will be described in further detail as an illustrative example.

The first pixel group PG1 includes a first pixel PX1 and a second pixel PX2, which are disposed adjacent to each other along the first direction DR1.

The first and second pixels PX1 and PX2 share the third sub-pixel SP3_W.

The third sub-pixel SP3_W shared in the first pixel group PG1 displays a white color. In addition, the eighth sub-pixel SP8_W shared in the second pixel group PG2 displays a white color. That is, the shared sub-pixel of the display panel 103 shown in FIG. 15 may be a white sub-pixel.

In the present exemplary embodiment, each of the first and second pixels PX1 and PX2 includes two and a half sub-pixels. In detail, the first pixel PX1 includes the first sub-pixel SP1_R, the second sub-pixel SP2_G, and a half of the third sub-pixel SP3_W, which are arranged along the first direction DR1. The second pixel PX2 includes the remaining half of the third sub-pixel SP3_W, the fourth sub-pixel SP4_B, and the fifth sub-pixel SP5_G, which are arranged along the first direction DR1.

In the present exemplary embodiment, the number of sub-pixels may be two and a half times greater than the number of pixels. For instance, the first and second pixels PX1 and PX2 are configured to collectively include five sub-pixels SP1_R, SP2_G, SP3_W, SP4_B, and SP5_G.

The aspect ratio, i.e., a ratio of a length T1 along the first direction DR1 to a length T2 along the second direction DR2, of each of the first and second pixels PX1 and PX2 is substantially 1:1. The aspect ratio of each of the first and second pixel groups PG1 and PG2 is substantially 2:1.

The aspect ratio, i.e., a ratio of a length T3 along the first direction DR1 to a length T2 along the second direction DR2, of each of the first sub-pixel SP1_R, the fourth sub-pixel SP4_B, the sixth sub-pixel SP6_B, and the ninth sub-pixel SP9_R is substantially 2:3.75.

The aspect ratio, i.e., a ratio of a length T4 along the first direction DR1 to the length T2 along the second direction DR2, of each of the second sub-pixel SP2_G, the fifth sub-pixel SP5_G, the seventh sub-pixel SP7_G, and the tenth sub-pixel SP10_G is substantially 1:3.75.

The aspect ratio, i.e., a ratio of a length T5 along the first direction DR1 to the length T2 along the second direction DR2, of each of the third sub-pixel SP3_W and the eighth sub-pixel SP8_W is substantially 1.5:3.75.

The process of generating data applied to the display panel 103 shown in FIG. 15 is substantially similar to the process described with reference to FIGS. 5 to 11C, and thus detailed descriptions of the rendering operation will be omitted.

According to the display panel 103 shown in FIG. 15, two pixels of each pixel group share a white sub-pixel. Accordingly, the brightness of the display panel 103 may be increased as compared with an RGB stripe structure in which one pixel includes three RGB sub-pixels, and as compared with a structure in which one pixel includes RG sub-pixels or BG sub-pixels. In addition, since one pixel of the display panel 103 shown in FIG. 15 includes two and a half sub-pixels, the aperture ratio and the light transmittance of the display panel 103 may be increased as compared with the structure in which one pixel includes three or more sub-pixels.

Figure 16:
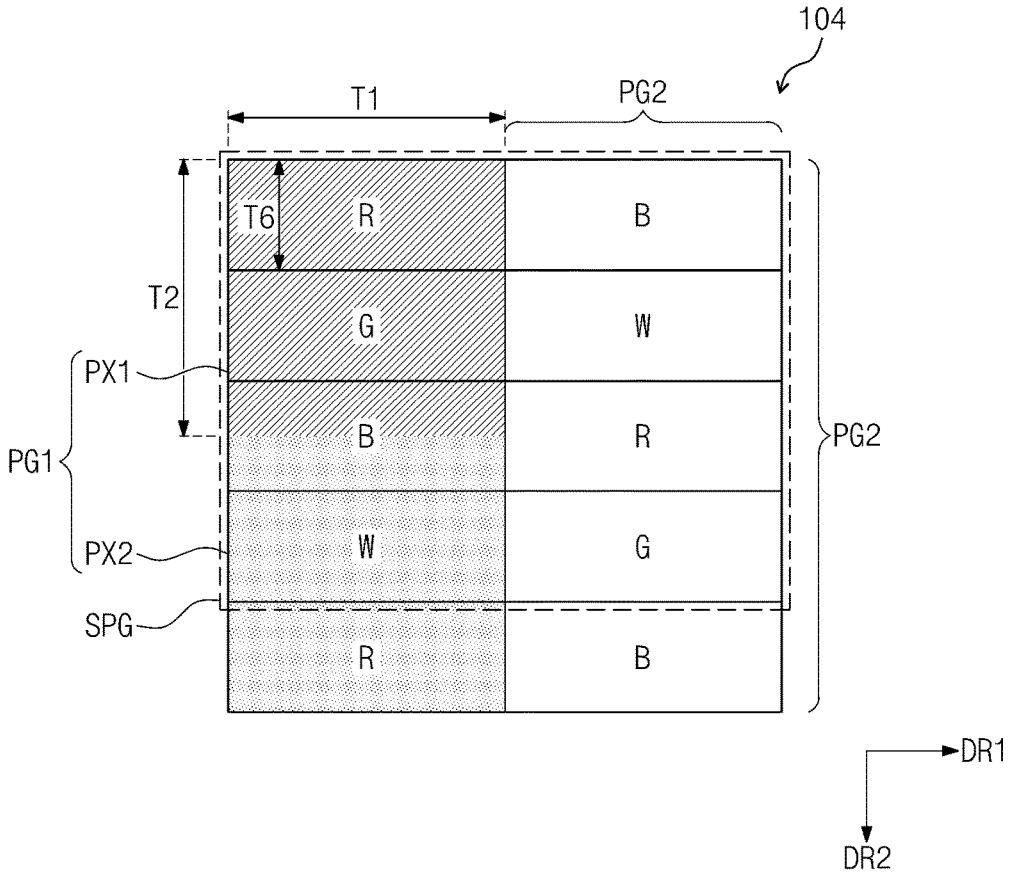

FIG. 16 is a view showing a portion of a display panel 104 according to another exemplary embodiment of the present disclosure.

Different from the display panel 100 shown in FIG. 2, the long side of the sub-pixel extends along the first direction DR1 and two pixels adjacent to each other along the second direction DR2 share a shared sub-pixel. Hereinafter, features of the display panel 104 shown in FIG. 16 that differ from the display panel 100 shown in FIG. 2 will be described in further detail.

Referring to FIG. 16, sub-pixels R, G, B, and W are repeatedly arranged within sub-pixel group SPG, which is configured to include eight sub-pixels arranged in four rows by two columns. The sub-pixel group SPG includes two red sub-pixels R, two green sub-pixels G, two blue-sub pixels B, and two white sub-pixels W.

In FIG. 16, the sub-pixels arranged in the first column of the sub-pixel group SPG are arranged in order of a red sub-pixel R, a green sub-pixel G, a blue sub-pixel B, a white sub-pixel W along the second direction DR2. In addition, the sub-pixels arranged in the second column of the sub-pixel group SPG are arranged in order of a blue sub-pixel B, a white sub-pixel W, a red sub-pixel R, a green sub-pixel G along the second direction DR2. However, the arrangement of the colors of the sub-pixels should not be limited to that shown.

The display panel 104 includes pixel groups PG1 and PG2, each including two pixels adjacent to each other. The pixel groups PG1 and PG2 have the same structure except for the difference in color arrangement of the sub-pixels thereof, and thus hereinafter, only the first pixel group PG1 will be described in further detail.

The first pixel group PG1 includes a first pixel PX1 and a second pixel PX2, which are disposed adjacent to each other along the second direction DR2.

The first and second pixels PX1 and PX2 share the shared sub-pixel B.

In the present exemplary embodiment, each of the first and second pixels PX1 and PX2 includes two and a half sub-pixels. In detail, the first pixel PX1 includes a red sub-pixel R, a green sub-pixel G, and half of the blue sub-pixel B, which are arranged along the second direction DR2. The second pixel PX2 includes the remaining half of the blue sub-pixel B, a white sub-pixel W, and a red sub-pixel R, which are arranged along the second direction DR2.

In the present exemplary embodiment, the number of the sub-pixels may be two and a half times greater than the number of the pixels. For instance, the first and second pixels PX1 and PX2 are collectively configured to include five sub-pixels R, G, B, W, and R.

The aspect ratio, i.e., a ratio of the length T1 along the first direction DR1 to the length T2 along the second direction DR2, of each of the first and second pixels PX1 and PX2 is substantially 1:1. The aspect ratio of each of the first and second pixel groups PG1 and PG2 is substantially 1:2.

The aspect ratio, i.e., a ratio of the length T1 along the first direction DR1 to the length T6 along the second direction DR2, is substantially 2.5:1.

According to the display panel 104 shown in FIG. 16, the long side of the sub-pixels extends along the first direction DR1, and thus the number of data lines in the display panel 104 may be reduced as compared with the number of the data lines of the display panel 100 shown in FIG. 2. Therefore, the number of driver ICs may be reduced and the manufacturing cost of the display panel may be reduced.

The arrangement of the sub-pixels of the display panel 104 shown in FIG. 16 is similar to the arrangement of the sub-pixels of the display panel 100 shown in FIG. 2 when the display panel 100 shown in FIG. 2 is rotated in a counter-clockwise direction at an angle of about 90 degrees and then mirrored about axis DR1. Similarly, the sub-pixels according to another exemplary embodiment may be repeatedly arranged in the unit of sub-pixel group configured to include the sub-pixels arranged in five rows by two columns and rotated in a clockwise or counter clockwise direction at an angle of about 90 degrees and then mirrored about axis DR1.

Figure 17:
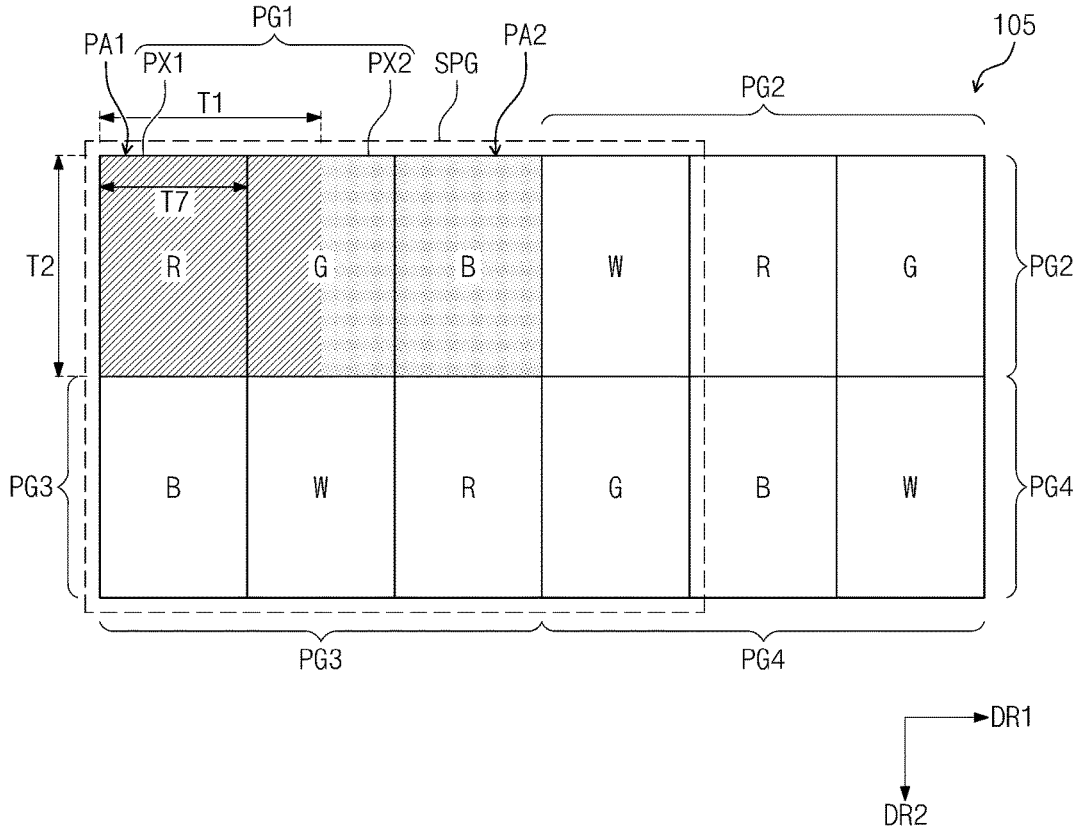

FIG. 17 is a view showing a portion of a display panel 105 according to another exemplary embodiment of the present disclosure.

Referring to FIG. 17, the display panel 105 includes sub-pixels R, G, B, and W. The sub-pixels R, G, B, and W each display one of the primary colors. In the present exemplary embodiment, the primary colors are configured to include red, green, blue, and white colors. Accordingly, the sub-pixels R, G, B, and W are configured to include a red sub-pixel R, a green sub-pixel G, a blue sub-pixel B, and a white sub-pixel W. However, the primary colors should not be limited to the above-mentioned colors. That is, the primary colors may further include yellow, cyan, and magenta colors.

The sub-pixels are repeatedly arranged in the unit of sub-pixel group SPG, which is configured to include eight sub-pixels arranged in two rows by four columns.

In the sub-pixel group SPG shown in FIG. 17, the sub-pixels in a first row are arranged along the first direction DR1 in order of the red, green, blue, and white sub-pixels R, G, B, and W. In addition, the sub-pixels in a second row are arranged along the first direction DR1 in order of the blue, white, red, and green sub-pixels B, W, R, and G. Meanwhile, the arrangement order of the sub-pixels of the sub-pixel group SPG should not be limited thereto or thereby.

The display panel 105 includes pixel groups PG1 to PG4. Each of the pixel groups PG1 to PG4 includes two pixels adjacent to each other. FIG. 17 shows four pixel groups PG1 to PG4 as a representative example. The pixel groups PG1 to PG4 have the same structure except for the arrangement order of the sub-pixels included therein. Hereinafter, a first pixel group PG1 will be described in further detail.

The first pixel group PG1 includes a first pixel PX1 and a second pixel PX2 adjacent to the first pixel PX1 along the first direction DR1.

The display panel 105 includes a plurality of pixel areas PA1 and PA2, in which the pixels PX1 and PX2 are disposed, respectively. In this case, the pixels PX1 and PX2 exert influence on a resolution of the display panel 105 and the pixel areas PA1 and PA2 refer to areas in which the pixels are disposed. Each of the pixel areas PA1 and PA2 displays two different colors from each other.

Each of the pixel areas PA1 and PA2 corresponds to an area in which a ratio, e.g., an aspect ratio, of a length along the first direction DR1 to a length along the second direction DR2 is 1:1. Hereinafter, one pixel may include a portion of one sub-pixel due to the shape (aspect ratio) of the pixel area. According to the present exemplary embodiment, one independent sub-pixel, e.g., the green sub-pixel G of the first pixel group PG1, is not fully included in one pixel. That is, one independent sub-pixel, e.g., the green sub-pixel G of the first pixel group PG1, may be partially included in, or shared by, two pixels.

The first pixel PX1 is disposed in the first pixel area PA1 and the second pixel PX2 is disposed in the second pixel area PA2.

In the first and second pixel areas PA1 and PA2 together, n ("n" is an odd number equal to or greater than 3) sub-pixels R, G, and B are disposed. In the present exemplary embodiment, n is 3, and thus three sub-pixels R, G, and B are disposed in the first and second pixel areas PA1 and PA2.

Each of the sub-pixels R, G, and B may be included in any one of the pixel groups PG1 to PG4. That is, the sub-pixels R, G, and B may not be commonly included in two or more pixel groups.

Among the sub-pixels R, G, and B, an {(n+1)/2}th sub-pixel G (hereinafter, referred to as a shared sub-pixel) in the first direction DR1 overlaps the first and second pixel areas PA1 and PA2. That is, the shared sub-pixel G is disposed at a center portion of the collective first and second pixels PX1 and PX2, and overlaps the first and second pixel areas PA1 and PA2.

The first and second pixels PX1 and PX2 may share the shared sub-pixel G. In this case, the sharing of the shared sub-pixel G means that the green data applied to the shared sub-pixel G is generated on the basis of a first green data corresponding to the first pixel PX1 among the input data RGB and a second green data corresponding to the second pixel PX2 among the input data RGB.

Similarly, two pixels included in each of the second to fourth pixel groups PG2 to PG4 may share one shared sub-pixel. The shared sub-pixel of the first pixel group PG1 is the green sub-pixel G, the shared sub-pixel of the second pixel group PG2 is the red sub-pixel R, the shared sub-pixel of the third pixel group PG3 is the white sub-pixel W, and the shared sub-pixel of the fourth pixel group PG4 is the blue sub-pixel B.

That is, the display panel 105 includes the first to fourth pixel groups PG1 to PG4, each including two pixels adjacent to each other, and the two pixels PX1 and PX2 of each of the first to fourth pixel groups PG1 to PG4 share one sub-pixel.

The first and second pixels PX1 and PX2 are driven during the same horizontal scanning period (1h). That is, the first and second pixels PX1 and PX2 are connected to the same gate line and driven by the same gate signal. Similarly, the first and second pixel groups PG1 and PG2 may be driven during a first horizontal scanning period and the third and fourth pixel groups PG3 and PG4 may be driven during a second horizontal scanning period.

In the present exemplary embodiment, each of the first and second pixels PX1 and PX2 includes one and a half sub-pixels. In detail, the first pixel PX1 includes the red sub-pixel R and a half of the green sub-pixel G along the first direction DR1. The second pixel PX2 includes a remaining half of the green sub-pixel G and the blue sub-pixel B along the first direction DR1.

In the present exemplary embodiment, the sub-pixels included in each of the first and second pixels PX1 and PX2 display two different colors. The first pixel PX1 displays red and green colors and the second pixel PX2 displays green and blue colors.

In the present exemplary embodiment, the number of the sub-pixels may be one and a half times greater than the number of the pixels. For instance, the two pixels PX1 and PX2 together include the three sub-pixels R, G, and B. In other words, the three sub-pixels R, G, and B are disposed in the first and second areas PA1 and PA2, in which the first and second pixels PX1 and PX2 are disposed, along the first direction DR1.

Each of the first and second pixels PX1 and PX2 has an aspect ratio of 1:1, i.e., a ratio of a length T1 along the first direction DR1 to a length T2 along the second direction DR2.

Each of the sub-pixels R, G, B, and W has an aspect ratio of 1:1.5, i.e., a ratio of a length T7 along the first direction DR1 to the length T2 along the second direction DR2.

In the present exemplary embodiment, the sub-pixels arranged in two rows by three columns may have a substantially square shape. That is, the sub-pixels included in the first and third pixel groups PG1 and PG3 may collectively have a square shape.

In addition, each of the first to fourth pixel groups PG1 to PG4 has an aspect ratio of 2:1. When explaining the first pixel group PG1 as a representative example, the first pixel group PG1 includes n (n is an odd number equal to or larger than 3) sub-pixels R, G, and B. Each of the sub-pixels R, G, and B included in the first pixel group PG1 has an aspect ratio of 2:n. Since the "n" is 3 in the exemplary embodiment shown in FIG. 17, the aspect ratio of each of the sub-pixels R, G, and B is 1:1.5.

According to the display apparatus of the present disclosure, since the one pixel includes one and a half (1.5) sub-pixels, the number of data lines in the display apparatus may be reduced to ½ even though the display apparatus displays the same resolution as that of the RGB stripe structure. In addition, the number of data lines in the display apparatus may be reduced by ¾ even though the display apparatus displays the same resolution as that of the structure in which one pixel includes two RGBW sub-pixels. When the number of data lines is reduced, the circuit configuration of the data driver 400 (refer to FIG. 1) becomes simpler, and thus a manufacturing cost of the data driver 400 is reduced. In addition, the aperture ratio of the display apparatus is increased since the number of data lines is reduced.

Hereinafter, the process of generating the data applied to the display panel 105 shown in FIG. 17 is described. In the present exemplary embodiment, differences between the process of generating the data applied to the display panel 105 shown in FIG. 17 and the process described with reference to FIGS. 5 to 11C will be mainly described.

Figure 18:
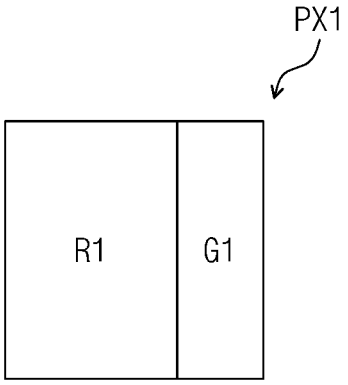
FIG. 18 is a view showing a first pixel disposed in a fifth pixel area shown in FIG. 7.

FIG. 18 is a view showing a first pixel disposed in a fifth pixel area shown in FIG. 7, and FIGS. 19A and 19B are views showing a re-sample filter used to generate a first pixel data shown in FIG. 18.

FIG. 18 shows a first pixel PX1 configured to include a red sub-pixel R1 and a portion of a green sub-pixel G1 as a representative example. The red sub-pixel R1 may be referred to as a first normal sub-pixel and the green sub-pixel G1 may be referred to as a first shared sub-pixel.

Referring to FIGS. 6, 7, and 18, the red sub-pixel R1 (first normal sub-pixel) is included in the first pixel PX1 as an independent sub-pixel. The green sub-pixel G1 (first shared sub-pixel) corresponds to a portion of the shared sub-pixel. The green sub-pixel G1 does not serve as an independent sub-pixel and is to process the data of the portion of the shared sub-pixel included in the first pixel PX1. That is, the green sub-pixel G1 of the first pixel PX1 forms one independent shared sub-pixel together with a green sub-pixel G2 included in the adjacent second pixel PX2.

Hereinafter, the intermediate rendering data RGBW1 which corresponds to the first pixel PX1 is referred to as a first pixel data. The first pixel data is configured to include a first normal sub-pixel data corresponding to the first normal sub-pixel R1 and a first shared sub-pixel data corresponding to the first shared sub-pixel G1.

The first pixel data is generated on the basis of that portion of the RGBW data RGBW which corresponds to the fifth pixel area PA5 in which the first pixel PX1 is disposed, as well as the pixel areas PA1 to PA4 and PA6 to PA9 surrounding the fifth pixel area PA5.

The first to ninth pixel areas PA1 to PA9 are disposed at positions respectively defined by a first row and a first column, a second row and the first column, a third row and the first column, the first row and a second column, the second row and the second column, the third row and the second column, the first row and a third column, the second row and the third column, and the third row and the third column.

In the present exemplary embodiment, the first pixel data may be generated on the basis of the data corresponding to the first to ninth pixel areas PA1 to PA9, but the number of the pixel areas should not be limited thereto or thereby. For example, the first pixel data may instead be generated on the basis of the data corresponding to ten or more pixel areas.

The re-sample filter includes a first normal re-sample filter RF11 (refer to FIG. 19A) and a first shared re-sample filter GF11 (refer to FIG. 19B). The scale coefficient of the re-sample filter indicates a proportion of the RGBW data RGBW corresponding to each pixel area. The scale coefficient of the re-sample filter is equal to or greater than zero (0) and smaller than one (1).

FIG. 19A shows the first normal re-sample filter RF11 used to generate the first normal sub-pixel data of the first pixel data.

Referring to FIG. 19A, the scale coefficients of the first normal re-sample filter RF11 in the first to ninth pixel areas PA1 to PA9 are 0.0625, 0.125, 0.0625, 0.125, 0.375, 0.125, 0, 0.125, and 0, respectively.

The first rendering part 2151 multiplies the red data of the RGBW data RGBW which corresponds to the first to ninth pixel areas PA1 to PA9, by the scale coefficients in corresponding positions of the first normal re-sample filter RF11. For instance, the red data corresponding to the first pixel area PA1 is multiplied by the scale coefficient, e.g., 0.0625, of the first normal re-sample filter RF11 corresponding to the first pixel area PA1. Likewise, the red data corresponding to the second pixel area PA2 is multiplied by the scale coefficient, e.g., 0.125, of the first normal re-sample filter RF11 corresponding to the second pixel area PA2. Similarly, the red data corresponding to the ninth pixel area PA9 is multiplied by the scale coefficient, e.g., 0, of the first normal re-sample filter RF11 corresponding to the ninth pixel area PA9.

The first rendering part 2151 calculates a sum of the values obtained by multiplying the red data of the first to ninth pixel areas PA1 to PA9 by the scale coefficients of the first normal re-sample filter RF1, to produce the first normal sub-pixel data for the first normal sub-pixel R1 of the first pixel PX1.

FIG. 19B shows the first shared re-sample filter GF11 used to generate the first shared sub-pixel data of the first pixel data.

Referring to FIG. 19B, the scale coefficients of the first shared re-sample filter GF11 in the first to ninth pixel areas PA1 to PA9 are 0, 15/256, 0, 15/256, 47/256, 15/256, 15/256, 6/256, and 15/256, respectively.

The first rendering part 2151 multiplies the green data of the RGBW data RGBW which corresponds to the first to ninth pixel areas PA1 to PA9, by the scale coefficients in corresponding positions of the first shared re-sample filter GF11 and calculates a sum of the multiplied values as the first shared sub-pixel data for the first shared sub-pixel G1. The rendering operation that calculates the first shared sub-pixel data is substantially similar to that for the first normal sub-pixel data, and thus details thereof will be omitted.

Figure 20:
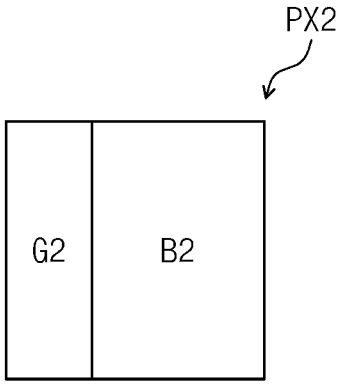
FIG. 20 is a view showing a second pixel disposed in an eighth pixel area shown in FIG. 7.

FIG. 20 is a view showing a second pixel disposed in an eighth pixel area shown in FIG. 7, and FIGS. 21A and 21B are views showing a re-sample filter used to generate a second pixel data for the pixel shown in FIG. 20.

FIG. 20 shows a second pixel PX2 configured to include green sub-pixel G2 and a blue sub-pixel B1 as a representative example. The blue sub-pixel B2 may be referred to as a second normal sub-pixel and the green sub-pixel G2 may be referred to as a second shared sub-pixel.

Referring to FIGS. 6, 7, and 20, the blue sub-pixel B2 (second normal sub-pixel) is included in the second pixel PX2 as an independent sub-pixel. The green sub-pixel G2 (second shared sub-pixel) corresponds to a remaining portion of the shared sub-pixel that includes the green sub-pixel G1 of the first pixel PX1. The green sub-pixel G2 of the second pixel PX2 forms the independent shared sub-pixel together with the green sub-pixel G1 included in the first pixel PX1.

Hereinafter, the data of the intermediate rendering data RGBW1 which corresponds to the second pixel PX2 is referred to as a second pixel data. The second pixel data is configured to include a second normal sub-pixel data corresponding to the second normal sub-pixel B2 and a first shared sub-pixel data corresponding to the second shared sub-pixel G2.

The second pixel data is generated on the basis of that RGBW data which corresponds to the eighth pixel area PA8 in which the second pixel PX2 is disposed, as well as the pixel areas PA4 to PA7 and PA9 to PA12 surrounding the eighth pixel area PA5.

The fourth to twelfth pixel areas PA4 to PA12 are disposed at positions respectively defined by a first row and a first column, a second row and the first column, a third row and the first column, the first row and a second column, the second row and the second column, the third row and the second column, the first row and a third column, the second row and the third column, and the third row and the third column.

In the present exemplary embodiment, the second pixel data may be generated on the basis of the data corresponding to the fourth to twelfth pixel areas PA4 to PA12, but the number of pixel areas used should not be limited thereto or thereby. For example, the first pixel data may be generated on the basis of the data corresponding to ten or more pixel areas.

The re-sample filter includes a second shared re-sample filter GF22 (refer to FIG. 21A) and a second normal re-sample filter BF22 (refer to FIG. 21B). The scale coefficient of the re-sample filter indicates a proportion of the RGBW data RGBW corresponding to each pixel area. The scale coefficient of the re-sample filter is equal to or greater than zero (0) and smaller than one (1).

FIG. 21A shows the second shared re-sample filter GF22 used to generate the second shared sub-pixel data of the second pixel data.

Referring to FIG. 21A, the scale coefficients of the second shared re-sample filter GF22 in the fourth to twelfth pixel areas PA4 to PA12 are 15/256, 6/256, 15/256, 15/256, 47/256, 15/256, 0, 15/256, and 0, respectively.

The first rendering part 2151 multiplies the blue data of the RGBW data which corresponds to the fourth to twelfth pixel areas PA4 to PA12, by the scale coefficients in corresponding positions of the second shared re-sample filter GF22. It then calculates a sum of the multiplied values as the second shared sub-pixel data for the second shared sub-pixel G2. The rendering operation that calculates the second shared sub-pixel data is substantially similar to that for the first shared sub-pixel data, and thus details thereof will be omitted.

FIG. 21B shows the second normal re-sample filter BF22 used to generate the second normal sub-pixel data of the second pixel data.

Referring to FIG. 21B, the scale coefficients of the second normal re-sample filter BF22 in the fourth to twelfth pixel areas PA4 to PA12 are 0, 0.125, 0, 0.125, 0.375, 0.125, 0.0625, 0.125, and 0.0625, respectively.

The first rendering part 2151 multiplies the blue data of the RGBW data which corresponds to the fourth to twelfth pixel areas PA4 to PA12, by the scale coefficients in corresponding positions of the second normal re-sample filter BF22. It then calculates a sum of the multiplied values as the second normal sub-pixel data for the second normal sub-pixel B2. The rendering operation that calculates the second normal sub-pixel data is substantially similar to that of the first normal sub-pixel data, and thus details thereof will be omitted.

Referring to FIGS. 6, 7, 18, and 20, the second rendering part 2153 calculates the first and second shared sub-pixel data of the intermediate rendering data RGBW1 to generate a shared sub-pixel data. The second rendering part 2153 may generate the shared sub-pixel data by adding the first shared sub-pixel data of the first pixel data and the second shared sub-pixel data of the second pixel data.

Figure 22:
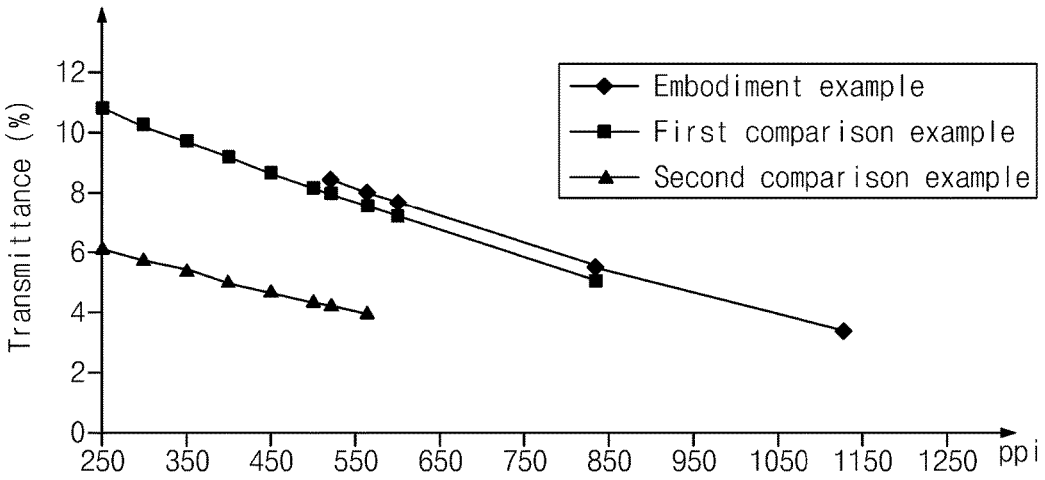
FIG. 22 is a graph showing a transmittance as a function of a pixel density, i.e., a pixel per inch (ppi), of the display apparatus including the display panel shown in FIG. 2, a first comparison example, and a second comparison example.

FIG. 22 is a graph showing a transmittance as a function of a pixel density (hereinafter, referred to as a pixel per inch (ppi)), for a display apparatus including the display panel shown in FIG. 17, a first comparison example, and a second comparison example. The following Table 2 shows the transmittance as a function of ppi, for a display apparatus including the display panel shown in FIG. 17, the first comparison example, and the second comparison example.

TABLE 2

| | | ppi | | | | | | | | | | |
|---|---|---|---|---|---|---|---|---|---|---|---|---|
| | | 250 | 299 | 350 | 399 | 450 | 500 | 521 | 564 | 600 | 834 | 1128 |
| Transmittance (%) | Embodiment example | | | | | | | 8.4 | 7.9 | 7.6 | 5.5 | 3.4 |
| | First comparison example | 10.8 | 10.2 | 9.7 | 9.2 | 8.7 | 8.2 | 8.0 | 7.5 | 7.2 | 5.0 | |
| | Second comparison example | 6.12 | 5.75 | 5.39 | 5.05 | 4.70 | 4.38 | 4.25 | 3.98 | | | |

In the present exemplary embodiment, the scale coefficients of the re-sample filter are determined by taking the area of the corresponding sub-pixel in each pixel into consideration. Hereinafter, and with reference to FIGS. 18 and 20, the first and second pixels PX1 and PX2 will be described as a representative example.

In the first pixel PX1, the area of the first normal sub-pixel R1 is greater than that of the first shared sub-pixel G1. More specifically, the area of the first normal sub-pixel R1 is two times greater than that of the first shared sub-pixel G1.

Accordingly, a sum of the scale coefficients of the first shared re-sample filter GF11 may be half of that of the scale coefficients of the first normal re-sample filter RF11. Referring to FIGS. 19A and 19B, the sum of the scale coefficients of the first normal re-sample filter RF11 becomes 1 and the sum of the scale coefficients of the first shared re-sample filter GF11 becomes 0.5.

Accordingly, the maximum grayscale of the first shared sub-pixel data corresponds to one half of the maximum grayscale of each of the first and second normal sub-pixel data.

Similarly, in the second pixel PX2, the area of the second normal sub-pixel B2 is greater than that of the second shared sub-pixel G2. In particular, the area of the second normal sub-pixel B2 is two times greater than that of the second shared sub-pixel G2.

A sum of the scale coefficients of the second shared re-sample filter GF22 may thus be one half of that of the scale coefficients of the second normal re-sample filter BF22. Referring to FIGS. 21A and 21B, the sum of the scale coefficients of the second normal re-sample filter BF22 becomes 1 and the sum of the scale coefficients of the second shared re-sample filter GF22 becomes 0.5.

Therefore, the maximum grayscale of the second shared sub-pixel data corresponds to a half of the maximum grayscale of the second normal sub-pixel data.

In FIG. 22 and Table 2, the first comparison example indicates a structure in which one pixel is configured to include two RGBW sub-pixels along the first direction DR1, and the second comparison example indicates an RGB stripe structure in which one pixel is configured to include three sub-pixels along the first direction DR1.

In FIG. 22 and Table 2, a maximum ppi of the embodiment example, the first comparison example, and the second comparison example indicates a value measured when a process threshold value for a short side (a length along the first direction DR1 of each sub-pixel in the display panel shown in FIG. 2) of each sub-pixel is set to about 15 micrometers.

Referring to FIG. 22 and Table 2, the display apparatus including the display panel shown in FIG. 17 has a maximum ppi higher than that of the first and second comparison examples under the same conditions. As an example, the display apparatus according to the present disclosure has a maximum ppi of about 1128, the first comparison example has a maximum ppi of about 834, and the second comparison example has a maximum ppi of about 564.

In addition, when the display apparatus of the embodiment example, the first comparison example, and the second comparison example have the same ppi, the display apparatus of the embodiment example has a transmittance higher than that of the first and second comparison examples. When each of the display apparatus of the embodiment example, the first comparison example, and the second comparison example have a ppi of about 564, the display apparatus of the embodiment example has a transmittance of about 7.9%, the first comparison example has a transmittance of about 7.5%, and the second comparison example has a transmittance of about 3.98%.

Figure 23:
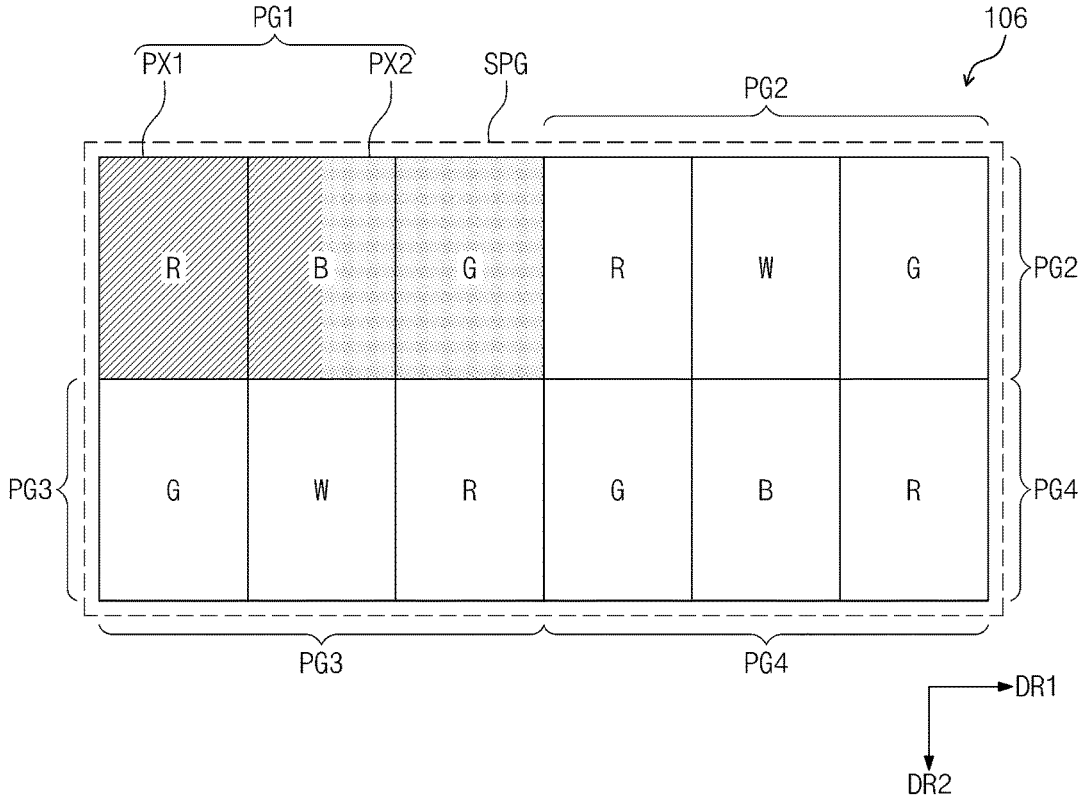
FIGS. 23, 24, 25, and 26 are views showing a portion of display panels according to other exemplary embodiments of the present disclosure.

FIG. 23 is a view showing a portion of a display panel 106 according to another exemplary embodiment of the present disclosure.

The display panel 106 shown in FIG. 23 has substantially the same structure and function as those of the display panel 105 shown in FIG. 17, except for the difference in color arrangement of the sub-pixels. Hereinafter, features of the display panel 106 that differ from those of the display panel 105 will mainly be described.

As shown in FIG. 23, the sub-pixels R, G, B, and W are repeatedly arranged in units of sub-pixel group SPG, which is configured to include twelve sub-pixels arranged in two rows by six columns. The sub-pixel group SPG includes four red sub-pixels, four green sub-pixels, two blue-sub pixels, and two white sub-pixels.

The sub-pixels arranged in the first row of the sub-pixel group SPG are arranged in order of a red sub-pixel R, a blue sub-pixel B, a green sub-pixel G, a red sub-pixel R, a white sub-pixel W, and a blue sub-pixel B along the first direction DR1. In addition, the sub-pixels arranged in the second row of the sub-pixel group SPG are arranged in order of a green sub-pixel G, a white sub-pixel W, a red sub-pixel R, a green sub-pixel G, a blue sub-pixel B, and a red sub-pixel R along the first direction DR1. However, the arrangement order of the sub-pixels should not be limited to the above-mentioned orders. As with every embodiment disclosed herein, any order of sub-pixels is contemplated.

Human eye color perception and resolution decreases in order of green, red, blue, and white, i.e., green>red>blue>white. According to the display panel 106 shown in FIG. 23, the red and green sub-pixels are much more prevalent in the display panel 106 than are the blue and white sub-pixels, and thus the perceived resolution of the display apparatus 102 may be improved.

Figure 24:
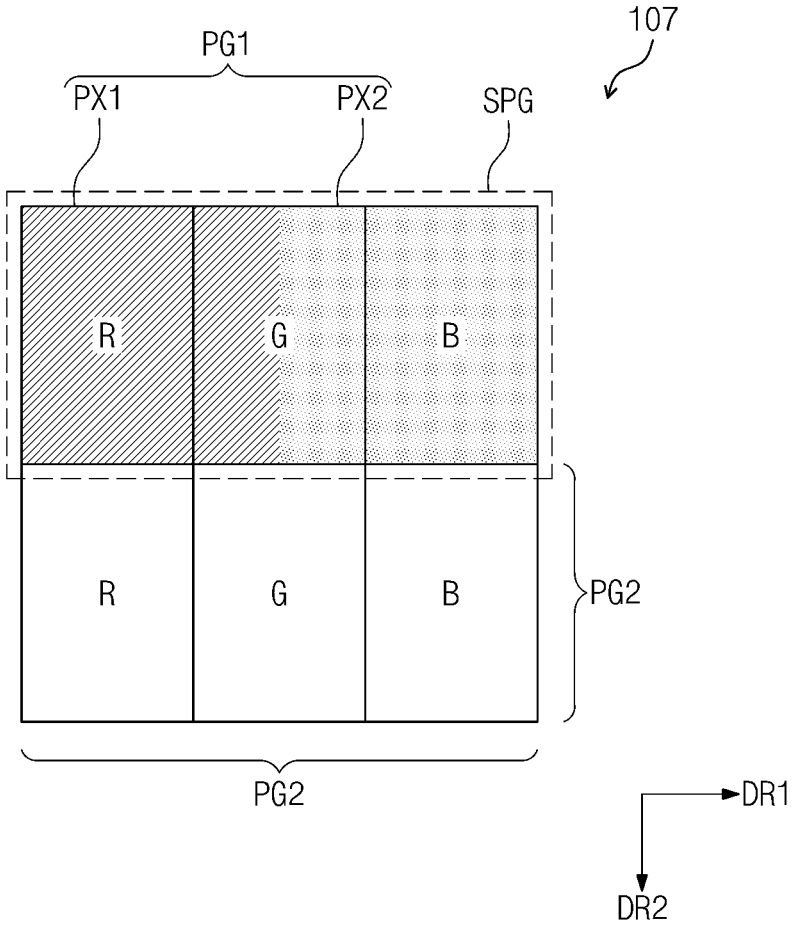

FIG. 24 is a view showing a portion of a display panel 107 according to another exemplary embodiment of the present disclosure.

The display panel 107 shown in FIG. 24 has substantially the same structure and function as those of the display panel 105 shown in FIG. 17, except for the difference in color arrangement of the sub-pixels. Hereinafter, features of the display panel 107 that differ from those of the display panel 105 will mainly be described.

As shown in FIG. 24, the display panel 107 includes a plurality of sub-pixels R, G, and B. The sub-pixels R, G, and B are repeatedly arranged in units of sub-pixel group SPG, which is configured to include three sub-pixels arranged in one row by three columns. The sub-pixel group SPG includes one red sub-pixel, one green sub-pixel, and one blue-sub pixel. That is, the display panel 107 shown in FIG. 24 does not include a white sub-pixel W when compared with the display panel 105 shown in FIG. 17.

The sub-pixels R, G, and B are arranged in units of three sub-pixels adjacent to each other along the first direction DR1. The three sub-pixels are arranged along the first direction DR1 in order of a red sub-pixel R, a green sub-pixel G, and a blue sub-pixel B. However, the arrangement order of the sub-pixels should not be limited to that shown. Any order is contemplated The display panel 107 includes pixel groups PG1 and PG2. Each of the pixel groups PG1 and PG2 of the display panel 107 shown in FIG. 24 has substantially the same structure and function as those of the pixel groups PG1 to PG4 shown in FIG. 17, except for the difference in color arrangement of the sub-pixels, and thus detailed descriptions of the pixel groups PG1 and PG2 will be omitted.

Figure 25:
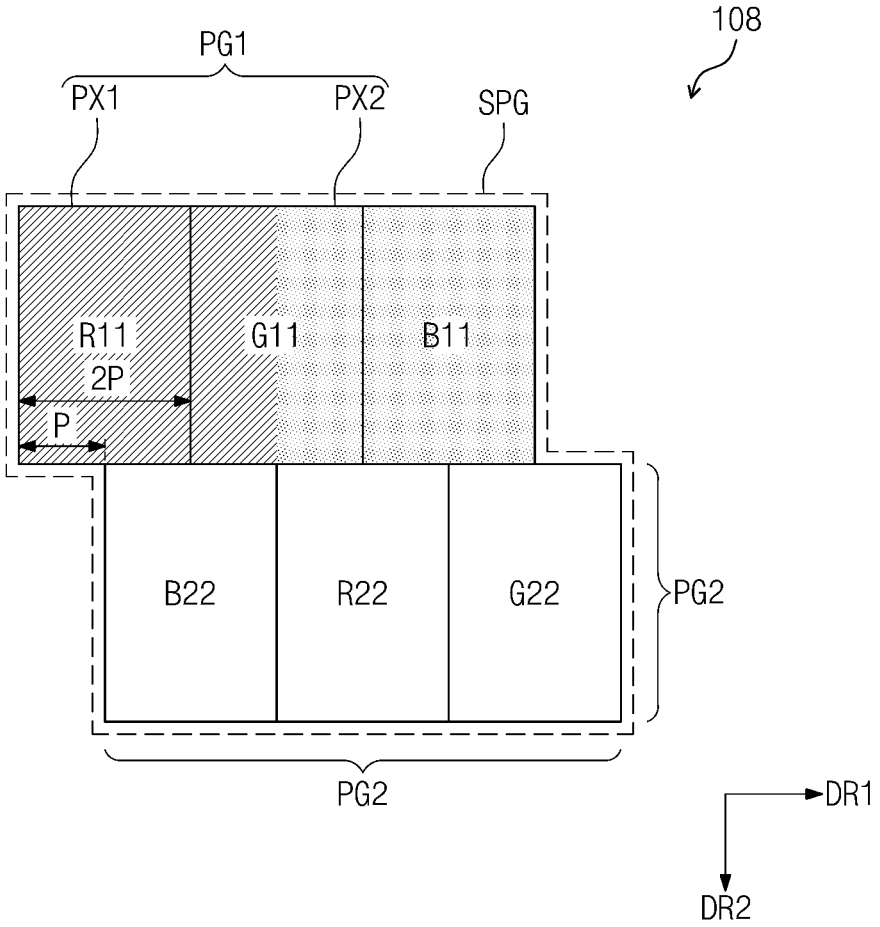

FIG. 25 is a view showing a portion of a display panel 108 according to another exemplary embodiment of the present disclosure.

The display panel 108 shown in FIG. 25 has substantially the same structure and function as those of the display panel 107 shown in FIG. 24, except for the difference in color arrangement of the sub-pixels. Hereinafter, features of the display panel 108 that differ from those of the display panel 107 will mainly be described.

Referring to FIG. 25, the sub-pixels are repeatedly arranged in the unit of sub-pixel group SPG, which is configured to include three sub-pixels R11, G11, and B11 arranged in a first row and three sub-pixels B22, R22, and G22 arranged in a second row. The sub-pixels R11, G11, and B11 disposed in the first row are arranged in order of a red sub-pixel R11, a green sub-pixel G11, and a blue sub-pixel B11 along the first direction DR1. In addition, the sub-pixels B22, R22, and G22 disposed in the first row are arranged in order of a blue sub-pixel B22, a red sub-pixel R22, and a green sub-pixel G22 along the first direction DR1.

The sub-pixels B22, R22, and G22 arranged in the second row are shifted or offset in the first direction DR1 by a first distance P corresponding to a half of a width 2P of a sub-pixel. The blue sub-pixel B22 arranged in the second row is shifted in the first direction DR1 by the first distance P with respect to the red sub-pixel R11 arranged in the first row, the red sub-pixel R22 arranged in the second row is shifted in the first direction DR1 by the first distance P with respect to the green sub-pixel G11 arranged in the first row, and the green sub-pixel G22 arranged in the second row is shifted in the first direction DR1 by the first distance P with respect to the blue sub-pixel B11 arranged in the first row.

The display panel 108 includes pixel groups PG1 and PG2. Each of the pixel groups PG1 and PG2 of the display panel 108 shown in FIG. 25 has the same structure and function as those of the pixel groups PG1 to PG4 shown in FIG. 17, except for the difference in color arrangement of the sub-pixels, and thus detailed descriptions of the pixel groups PG1 and PG2 will be omitted.

According to the display panel 108 shown in FIG. 25, a distance between the sub-pixels having the same color and being disposed adjacent to each other is uniform compared with the display panel 107 shown in FIG. 24. Accordingly, the display panel 108 shown in FIG. 25 may display images in more detail than the display panel 107 shown in FIG. 24, which has substantially the same resolution as that of the display panel 108 shown in FIG. 25.

Figure 26:
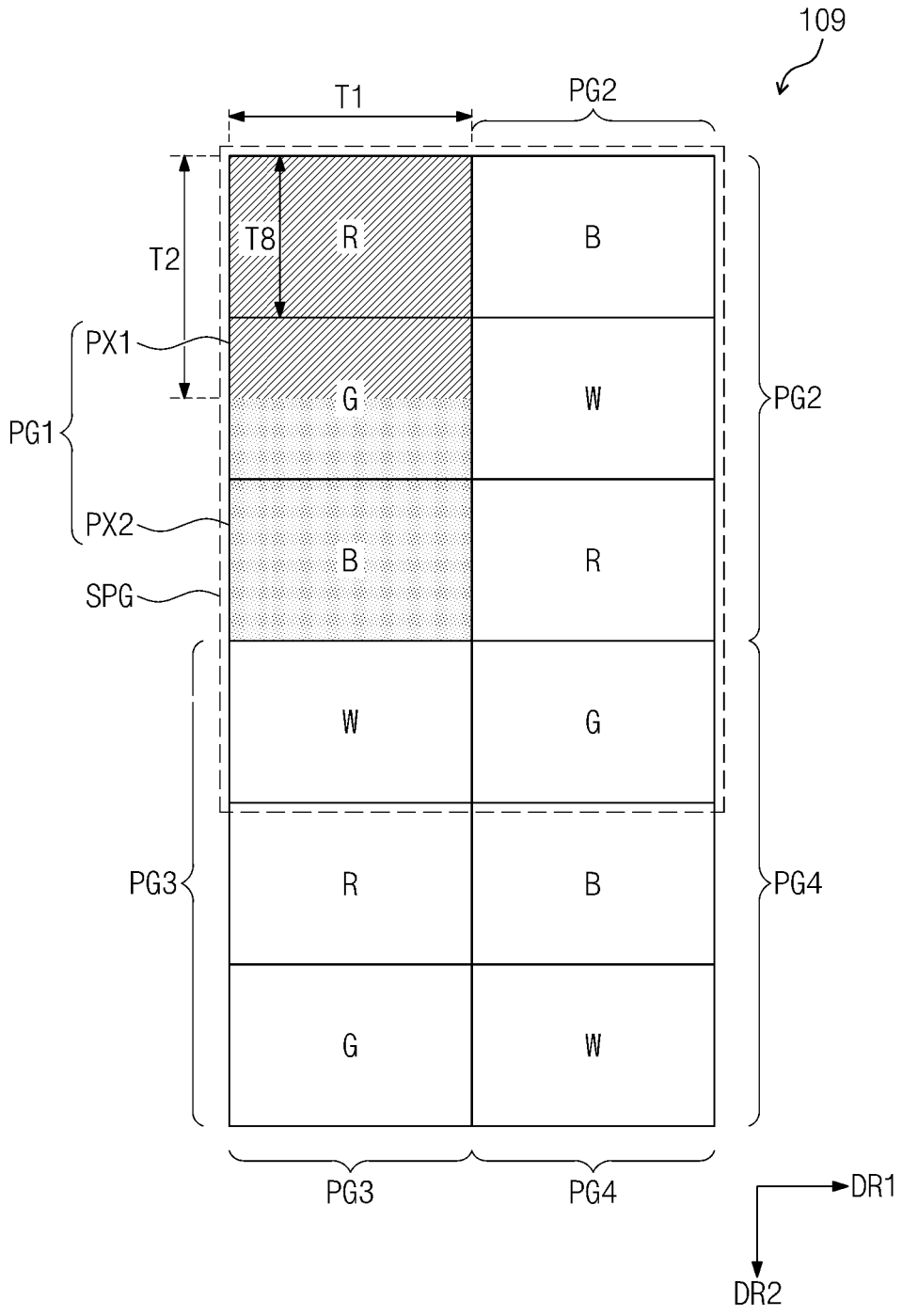

FIG. 26 is a view showing a portion of a display panel 109 according to another exemplary embodiment of the present disclosure.

Different from the display panel 105 shown in FIG. 17, the long side of the sub-pixel of the display panel 109 shown in FIG. 26 extends along the first direction DR1 and two pixels adjacent to each other along the second direction DR2 share a shared sub-pixel. Hereinafter, features of the display panel 109 that differ from the display panel 105 will be described in further detail.

Referring to FIG. 26, sub-pixels R, G, B, and W are repeatedly arranged in units of sub-pixel group SPG, which is configured to include eight sub-pixels arranged in four rows by two columns. The sub-pixel group SPG includes two red sub-pixels R, two green sub-pixels G, two blue-sub pixels B, and two white sub-pixels W.

As shown in FIG. 26, the sub-pixels arranged in the first column of the sub-pixel group SPG are arranged in order of a red sub-pixel R, a green sub-pixel G, a blue sub-pixel B, and a white sub-pixel W along the second direction DR2. In addition, the sub-pixels arranged in the second column of the sub-pixel group SPG are arranged in order of a blue sub-pixel B, a white sub-pixel W, a red sub-pixel R, and a green sub-pixel G along the second direction DR2. However, the arrangement order of the colors of the sub-pixels should not be limited to the above-mentioned orders.

The display panel 109 includes pixel groups PG1 to PG4, each including two pixels adjacent to each other. The pixel groups PG1 to PG4 have the same structure except for the difference in color arrangement of the sub-pixels thereof, and thus hereinafter, only the first pixel group PG1 will be described in detail.

The first pixel group PG1 includes a first pixel PX1 and a second pixel PX2, which are disposed adjacent to each other along the second direction DR2.

The first and second pixels PX1 and PX2 share a shared sub-pixel G.

In the present exemplary embodiment, each of the first and second pixels PX1 and PX2 includes one and a half sub-pixels. In detail, the first pixel PX1 includes a red sub-pixel R and half of a green sub-pixel G, which are arranged along the second direction DR2. The second pixel PX2 includes a remaining half of the green sub-pixel G and a blue sub-pixel B, which are arranged along the second direction DR2.

In the present exemplary embodiment, the number of sub-pixels may be one and a half times greater than the number of pixels. For instance, the first and second pixels PX1 and PX2 are configured to include three sub-pixels R, G, and B.

The aspect ratio, i.e., a ratio of a length T1 along the first direction DR1 to a length T2 along the second direction DR2, of each of the first and second pixels PX1 and PX2 is substantially 1:1. The aspect ratio, i.e., a ratio of the length along the first direction DR1 to the length along the second direction DR2, of each of the first to fourth pixel groups PG1 to PG4 is substantially 1:2.

The aspect ratio, i.e., a ratio of the length T1 along the first direction DR1 to the length T8 along the second direction DR2, is substantially 1.5:1.

According to the display panel 109 shown in FIG. 26, the long side of the sub-pixels extends along the first direction DR1, and thus the number of data lines in the display panel 109 may be reduced compared with the number of data lines in the display panel 105 shown in FIG. 17. Therefore, the number of driver ICs may be reduced and the manufacturing cost of the display panel may be reduced.

The arrangement of the sub-pixels of the display panel 109 shown in FIG. 26 is similar to the arrangement of the sub-pixels of the display panel 105 shown in FIG. 17 when the display panel 105 shown in FIG. 17 is rotated in a counter-clockwise direction at an angle of about 90 degrees and then mirrored about axis DR1. Similarly, the sub-pixels according to another exemplary embodiment may be repeatedly arranged in units of the sub-pixel groups shown in FIGS. 23 and 24, when rotated in a clockwise or counter clockwise direction at an angle of about 90 degrees and then mirrored about axis DR1.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed. Accordingly, any features of the above described and other embodiments may be mixed and matched in any manner, to produce further embodiments within the scope of the invention.

What is claimed is:

1. A display apparatus comprising:

a plurality of sub-pixels comprising at least one shared sub-pixel; and a plurality of pixels each comprising a normal sub-pixel, wherein the plurality of pixels comprises a first pixel and a second pixel, the first pixel is neighborly and physically adjacent to the second pixel, the first pixel and the second pixel together share a shared sub-pixel of the at least one shared sub-pixel, and a total number of the sub-pixels of each of the first pixel and the second pixel is x.5 (where x is a natural number), wherein the first pixel does not comprise an entirety of the second pixel, and the second pixel does not comprise an entirety of the first pixel.

2. The display apparatus of claim 1, wherein x=1 or 2.

3. The display apparatus of claim 2, wherein the at least one shared sub-pixel and the normal sub-pixel has an aspect ratio of 1:2.5 or 1:1.5.

4. The display apparatus of claim 1, wherein the entirety of the first pixel is neighborly and physically adjacent to the entirety of the second pixel along a first direction.

5. The display apparatus of claim 1, wherein the shared sub-pixel of the at least one shared sub-pixel is one color.

6. The display apparatus of claim 1, wherein the total number of the sub-pixels of each of the first pixel and the second pixel is 1.5 or 2.5.

* * * * *